US008543037B2

(12) United States Patent
Egawa et al.

(10) Patent No.: US 8,543,037 B2
(45) Date of Patent: Sep. 24, 2013

(54) IMAGE FORMING APPARATUS

(75) Inventors: Kazuhiro Egawa, Numazu (JP); Yukio Fujiwara, Numazu (JP); Hidetoshi Kami, Numazu (JP); Kohichi Ohshima, Mishima (JP)

(73) Assignee: Ricoh Company, Ltd., Tokyo (JP)

( * ) Notice: Subject to any disclaimer, the term of this patent is extended or adjusted under 35 U.S.C. 154(b) by 539 days.

(21) Appl. No.: 12/610,542

(22) Filed: Nov. 2, 2009

(65) Prior Publication Data

US 2010/0124712 A1 May 20, 2010

(30) Foreign Application Priority Data

Nov. 14, 2008 (JP) ..... 2008-291650

(51) Int. Cl.
*G03G 21/10* (2006.01)

(52) U.S. Cl.
USPC ..... 399/159; 430/119.82; 430/119.84

(58) Field of Classification Search
USPC ..... 399/350, 231, 159; 430/119.82, 430/119.84
See application file for complete search history.

(56) References Cited

U.S. PATENT DOCUMENTS

| | | | | |
|---|---|---|---|---|
| 4,699,865 | A * | 10/1987 | Mitsuhashi | 430/119.72 |
| 4,804,607 | A * | 2/1989 | Atsumi | 430/67 |
| 5,114,814 | A * | 5/1992 | Sakoh et al. | 399/350 |
| 5,187,039 | A * | 2/1993 | Meyer | 399/265 |
| 5,381,211 | A * | 1/1995 | Godlove | 399/159 |
| 7,551,878 | B2 | 6/2009 | Ogaki et al. | |
| 7,556,901 | B2 | 7/2009 | Anezaki et al. | |
| 7,718,331 | B2 * | 5/2010 | Uematsu et al. | 430/56 |
| 2005/0266328 | A1 * | 12/2005 | Yanagawa et al. | 430/66 |

FOREIGN PATENT DOCUMENTS

| | | |
|---|---|---|
| JP | 63-65449 | 3/1988 |
| JP | 1-118139 | 5/1989 |
| JP | 10-73946 | 3/1998 |
| JP | 2001-66814 | 3/2001 |
| JP | 2001-166521 | 6/2001 |
| JP | 2002-169315 | 6/2002 |
| JP | 2002-196523 | 7/2002 |
| JP | 2006-259547 | 9/2006 |
| JP | 2007-233359 | 9/2007 |
| WO | WO 9844391 A1 * | 10/1998 |

OTHER PUBLICATIONS

Diamond, Arthur S & David Weiss (eds.) Handbook of Imaging Materials, 2nd ed.. New York: Marcel-Dekker, Inc. (Nov. 2001) pp. 164-168.*

* cited by examiner

*Primary Examiner* — Christopher Rodee
(74) *Attorney, Agent, or Firm* — Cooper & Dunham LLP

(57) ABSTRACT

The image forming apparatus includes a photoreceptor bearing an electrostatic image; a developing device developing the electrostatic image with a developer including a toner to form a toner image on the photoreceptor; a transferring device transferring the toner image onto a receiving material; and a cleaning device having a cleaning blade cleaning the surface of the photoreceptor. The photoreceptor includes an electroconductive substrate, a photosensitive layer and an outermost layer having projected portions thereon. The outermost layer and projected portions include the same crosslinked charge transport material. The outermost layer has a surface roughness property such that the number of projected portions having height greater than Rz/2 is from 40 to 90 in a length of 12 mm, wherein Rz represents ten-point mean roughness of the outermost layer. The tip of the cleaning blade is contacted with the photoreceptor at a linear pressure of from 80 g/cm to 150 g/cm.

7 Claims, 8 Drawing Sheets

IMAGE FORMING APPARATUS

BACKGROUND OF THE INVENTION

1. Field of the Invention

The present invention relates to an electrophotographic image forming apparatus which produces images using toner and which includes at least a photoreceptor and a cleaning device including a cleaning blade for cleaning the surface of the photoreceptor.

2. Discussion of the Related Art

Conventional electrophotographic image forming apparatus typically produce visual images by performing the following processes:

(1) Charging a rotated electrophotographic photoreceptor (hereinafter referred to as photoreceptor or image bearing member), which has a drum form or a belt form, with a charging device to uniformly charge the peripheral surface of the photoreceptor (charging process);

(2) Irradiating the charged photoreceptor with imagewise light to form an electrostatic latent image thereon (light irradiating process);

(3) Developing the electrostatic latent image with a developer including a toner to form a toner image on the photoreceptor (developing process);

(4) Transferring the toner image onto a receiving material optionally via an intermediate transfer medium (transferring process);

(5) Fixing the toner image on the receiving material, resulting in formation of a visual image (fixing process); and (6) Cleaning the surface of the photoreceptor with a cleaning device so that the photoreceptor is ready for the next image forming operation (cleaning process).

As for the photoreceptor, organic photoreceptors in which a photosensitive layer including an organic photosensitive material is located on a substrate are typically used. Among the organic photoreceptors, layered organic photoreceptors having a photosensitive layer in which a layer including a charge generation material and another layer including a charge transport material are overlaid are mainly used because of having advantages in cost, productivity and material selection flexibility (i.e., various materials can be used therefor).

In the above-mentioned image formation processes, the electrophotographic photoreceptor faces various hazards such as mechanical external forces, electric hazards and chemical hazards, thereby deteriorating the photoreceptor. Particularly, since color images are frequently produced recently, the photoreceptor is required to have good durability so that the photoreceptor can produce high quality images over a long period of time.

The photoreceptor used for such image forming apparatus faces the following mechanical hazards. Specifically, the photoreceptor is contacted and rubbed with toner which typically includes toner particles including a colorant and a binder resin, and a hard particulate inorganic material serving as an external additive. In addition, the photoreceptor is strongly pressed to a paper sheet, which serves as a receiving material and which typically includes a hard filler such as fibers and clays, in the transferring process. Further, the photoreceptor is strongly scraped with a cleaning blade in the cleaning process. Therefore, the surface of the photoreceptor tends to be abraded. In attempting to impart good abrasion resistance to the photoreceptor, highly durable resins such as polycarbonate and polyarylate are typically used as the binder resin of the photoreceptor as disclosed in published unexamined Japanese patent applications Nos. (hereinafter referred to as JP-As) 01-118139 and 10-73946.

Photoreceptors having a protective layer as the outermost layer have been proposed in attempting to impart good mechanical durability thereto. For example, protective layers in which a hard particulate metal oxide is dispersed, and crosslinked protective layers have been disclosed in JP-A 2001-166521. In addition, JP-As 63-65449 and 2002-196523 have disclosed techniques such that a good lubricating property is imparted to the surface of the photoreceptor to reduce abrasion of the surface of the photoreceptor.

Cleaning devices used for electrophotographic image forming apparatus typically use a cleaning blade made of an elastic material such as urethane rubbers as a cleaning member because such a cleaning blade has a simple structure and good cleanability. In the cleaning device, the tip (i.e., tip edge line) of the blade is contacted with the peripheral surface of the photoreceptor to scrape residual toner particles off the surface of the photoreceptor.

Recently, a need exists for an electrophotographic image forming apparatus capable of producing high quality images. In attempting to fulfill the need, the particle diameter of toner becomes smaller and smaller and the form of toner particles becomes more and more similar to the spherical form. Therefore, spherical toner prepared by a polymerization method has been mainly used for electrophotographic image forming apparatus recently.

However, when small and spherical toner is used, it becomes difficult to well remove residual toner particles from a photoreceptor using a cleaning blade, resulting in defective cleaning. This is because the residual toner particles present at the contact point of the cleaning blade with the photoreceptor have a rotational moment and therefore the toner particles easily pass through the gap between the cleaning blade and the photoreceptor. Therefore, when small and spherical toner is used, it is preferable to increase the pressure (hereinafter referred to as linear pressure) applied to the cleaning blade to prevent residual toner particles from passing through the gap between the cleaning blade and the photoreceptor.

When the linear pressure is increased, small and spherical toner can be well removed. However, increasing the linear pressure tends to cause problems in that the surface of the photoreceptor is seriously abraded; torque of driving the photoreceptor has to be increased; and the cleaning blade is seriously abraded.

Therefore, even when a photoreceptor having good mechanical durability is developed and used, there is a case where a small scratch or crack is formed on the surface of the photoreceptor after long repeated use or a case where the tip of the cleaning blade is chipped and thereby residual toner particles pass through the damaged portion, resulting in formation of a streak image (i.e., deterioration of image quality). This image quality deterioration problem is an urgent problem to be quickly solved for such a highly durable photoreceptor. In this regard, JP-A 2002-169315 discloses a technique in that a cleaning blade is pressed to a photoreceptor at a predetermined linear pressure, wherein the photoreceptor has a protective layer (outermost layer) including a crosslinked material.

Among various factors affecting the abrasion of photoreceptor, the most important factor is the pressure to the cleaning blade. If the transferability of toner can be improved, the pressure can be decreased, resulting in prevention of chipping of the cleaning blade. JP-A 2001-66814 discloses a technique in that projected and recessed portions having a special form such as prism forms, wave forms, cone forms, pyramid forms, and well forms are formed on the surface of a photoreceptor using a touch roll or stamper. In addition, it is described therein that by including a filler including silicon and fluorine in the entire charge transport layer to improve the transferability of toner and to reduce the stress applied to the photoreceptor. However, the technique has a drawback in that when the photoreceptor having projected and recessed portions thereon is repeatedly subjected to image forming operations and thereby the friction resistance of the photoreceptor surface is increased, the cleaning blade is easily chipped, thereby causing the streak image problem in that the residual toner particles pass through the chipped portion, resulting in formation of a streak image.

Because of these reasons, a need exists for an image forming apparatus having good cleanability, i.e., an image forming apparatus capable of producing high quality images without causing the streak image problem and toner filming problem, which are caused by passing of toner through the gap between the cleaning blade and the photoreceptor due to vibration, twisting, reversing and chipping of the cleaning blade.

SUMMARY OF THE INVENTION

As an aspect of the present invention, an image forming apparatus is provided. The image forming apparatus includes at least a photoreceptor, which has an electroconductive substrate, a photosensitive layer and an outermost layer and which is configured to bear an electrostatic image thereon; a developing device configured to develop the electrostatic image with a developer including a toner to form a toner image on the photoreceptor; a transferring device configured to transfer the toner image onto a receiving material optionally via an intermediate transfer medium; and a cleaning device having a cleaning blade configured to clean the surface of the photoreceptor after the toner image is transferred.

The outermost layer has projected portions thereon, and the outermost layer and the projected portions include the same crosslinked charge transport material.

In addition, the outermost layer has a surface roughness property such that the number of projections having a height greater than Rz/2 (Rz: ten-point mean roughness of the outermost layer) is from 40 to 90 in a scanning length of 12 mm when the ten-point mean roughness Rz is determined by the method defined in JIS B0601 (2001).

Further, the linear pressure of the tip edge line of the cleaning blade contacted with the photoreceptor is 80 g/cm to 150 g/cm.

These and other objects, features and advantages of the present invention will become apparent upon consideration of the following description of the preferred embodiments of the present invention taken in conjunction with the accompanying drawings.

DESCRIPTION OF THE PREFERRED EMBODIMENTS

Figure 1:
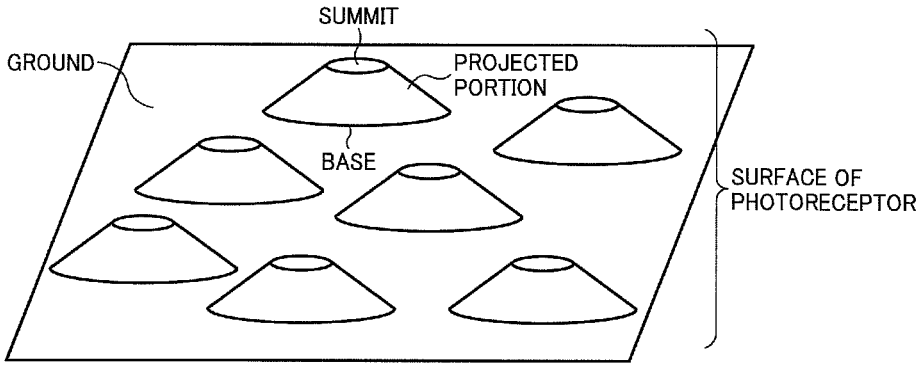
FIG. 1 is a schematic perspective view illustrating projected portions on the surface of a photoreceptor for use in the image forming apparatus of the present invention.

The present inventors discover that the above-mentioned need can be fulfilled by an image forming apparatus including:

(1) At least one photoreceptor, which has an electroconductive substrate, a photosensitive layer and an outermost layer and which is configured to bear an electrostatic image thereon;

(2) A developing device configured to develop the electrostatic image with a developer including a toner to form a toner image on the photoreceptor;

(3) A transferring device configured to transfer the toner image onto a receiving material optionally via an intermediate transfer medium; and (4) A cleaning device having a cleaning blade configured to clean the surface of the photoreceptor after the toner image is transferred.

The outermost layer has projected portions thereon, and the outermost layer and the projected portions includes the same crosslinked charge transport material.

In addition, the outermost layer has a surface roughness property such that the number of projections having a height greater than Rz/2 (Rz: ten point mean roughness of the surface of the outermost layer) is from 40 to 90 in a scanning length of 12 mm when the ten point mean roughness Rz is determined by the method defined in JIS B0601 (2001).

Further, the linear pressure of the tip edge line of the blade contacted with the photoreceptor is 80 g/cm to 150 g/cm.

The projected portions preferably have an average height of not greater than 5 μm when the scanning length is 12 mm.

The crosslinked charge transport material included in the outermost layer and the projected portions has a unit obtained from a triarylamine compound, which preferably has the following formula (1):

(1)

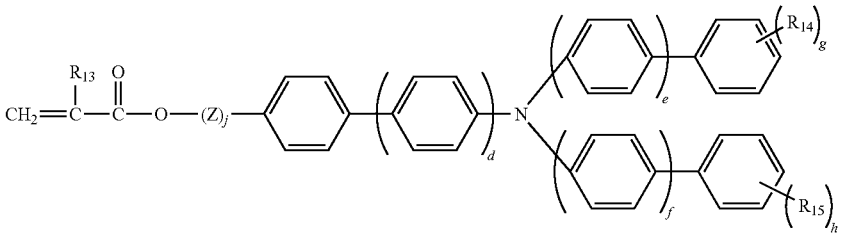

wherein each of d, e and f is 0 or 1; each of g and h is 0 or an integer of from 1 to 3; $R_{13}$ represents a hydrogen atom or a methyl group; each of $R_{14}$ and $R_{15}$ represents an alkyl group having from 1 to 6 carbon atoms, wherein when g is 2 or 3, the groups $R_{14}$ may be the same as or different from each other, and when h is 2 or 3, the groups $R_{15}$ may be the same as or different from each other; Z is a methylene group, an ethylene group or one of the following groups:

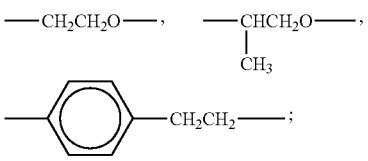

and j is 0 or 1.

The projected portions are preferably formed by a spray coating method.

The toner used for the developer is preferably a toner prepared by a polymerization method.

The image forming apparatus is preferably a tandem image forming apparatus which includes plural photoreceptors and a developing device including plural tandem developing units configured to form different color toner images on the respective photoreceptors.

The present invention will be explained in detail.

The image forming apparatus of the present invention includes a photoreceptor having a surface on which plural projected portions including a crosslinked resin are present. A cleaning blade is applied to the surface of the photoreceptor at a linear pressure of from 80 g/cm to 150 g/cm. When the surface of the photoreceptor is rubbed with the cleaning blade to remove residual toner particles from the surface, the tip edge portion of the blade is microscopically vibrated by the projected portions, and thereby toner particles and other foreign materials adhered to the tip edge portion of the cleaning blade can be released therefrom.

Since the cleaning blade is contacted with the surface of the photoreceptor at a relatively high linear pressure, the occurrence of the toner passing problem can be prevented. In addition, since the projected portions include a crosslinked resin, the projected portions are hardly damaged even when the projected portions are rubbed by the cleaning blade at a high linear pressure.

As mentioned above, the cleaning device of the image forming apparatus includes a cleaning blade which is contacted with the surface of the photoreceptor at a linear pressure of from 80 g/cm to 150 g/cm. In this case, residual toner particles can be well removed from the surface of the photoreceptor even when the toner particles have a relatively small particle diameter and a spherical form.

In this regard, the linear pressure (LP) is defined by the following equation:

$$LP(gf/\text{cm})=W/L,$$

wherein W represents the load (gf) applied to the cleaning blade; and L represents the length (cm) of the tip edge line of the cleaning blade contacted with the surface of the photoreceptor.

Specifically, the linear pressure of a cleaning blade is measured as follows. The cleaning blade is contacted with a photoreceptor so that the tip of the blade has a stick state while a sheet sensor having a thickness of 0.1 mm is inserted into the contact portion between the blade and the photoreceptor. The load (W) (in units of gf) applied to the contact portion is measured with the sensor. The thus determined load is divided by the length (L) (in units of cm) of the contact portion in the direction parallel to the axis of the photoreceptor.

In this regard, the sheet sensor has configuration such that a number of electrodes are arranged in a matrix in a plane (i.e., X and Y directions), and the electrodes are covered with a resin film. Each of the electrodes includes a pressure sensitive resistive material and a charge generation material, which are arranged in a matrix. When a load is applied to the intersection in the matrix, the resistance of the pressure sensitive resistive material changes depending on the load applied thereto. The change of the resistance can be determined by change of current flowing in the X and Y directions. Therefore, the load applied to the blade can be determined from the current.

When the linear pressure of the cleaning blade is lower than 80 g/cm, the phenomenon in that residual toner particles pass through the gap between the blade and the surface of the photoreceptor tends to occur, resulting in background development (i.e., formation of images whose background is soiled with the passing toner particles). In addition, in the next charging process using a contact charging member (such as charging rollers), the surface of the photoreceptor tends to be easily abraded by the residual toner and the charging member, resulting in deterioration of image qualities.

In contrast, when the linear pressure of the cleaning blade is higher than 150 g/cm, the filming problem in that a film of the toner is formed on the photoreceptor; a problem in that the surface of the photoreceptor is damaged by the residual toner; and an abrasion problem in that the surface of the photoreceptor is excessively abraded tend to be caused. In addition, other problems in that the cleaning blade is reversed (turned over) and the tip of the blade is chipped tend to be caused.

Therefore, the linear pressure of the cleaning blade is preferably controlled to fall in the range of from 80 g/cm to 150 g/cm.

The photoreceptor of the image forming apparatus of the present invention has a crosslinked outermost layer having a number of projected portions thereon, which includes a crosslinked charge transport material.

Conventionally, the surface roughness of a photoreceptor such as ten-point mean roughness (Rz) and Arithmetical Mean Deviation of the Profile (Ra) has been used for discussing the cleanability of the photoreceptor. However, the present inventors discover that the cleanability of a photoreceptor cannot be well expressed only by such surface roughness, and the cleanability depends on the conditions of projected portions located on the surface of the photoreceptor.

In JIS B0601 (2001), the ten-point mean roughness Rz is defined as the difference between the mean value of altitude of from the highest peak to the $5^{th}$ peak and the mean value of altitude of from the deepest valley to the $5^{th}$ valley. In contrast, in the present invention, the value of altitude (height) of projected portions (i.e., a distance of the base of the profile curve to the summit of the projected portions) is discussed.

Specifically, the ten-point mean roughness Rz is obtained from a profile of a surface determined by a surface roughness tester and a phase compensation band pass filter having cut-off values of λc and λs. The ten-point mean roughness Rz is represented by the following equation:

$$Rz=1/5\Sigma(Zpi+Zvj);\ (i, j=1\text{-}5)$$

wherein Zpi represents the distance (altitude) between the top of the i-th peak and the mean line of the profile curve and Zvj represents the distance between the bottom of the j-th valley and the mean line.

Thus, the higher five peaks and deeper five valleys among the peaks and valleys in the profile are used for determining the ten-point mean roughness Rz of the surface. However, there are various cases where the highest peak is or is not adjacent to the deepest valley; and peaks are or are not apart from valleys. Thus, even when the ten-point mean roughness Rz of two surfaces is the same, the conditions of the surfaces are not necessarily the same. In addition, the profile has many peaks and valleys which are not considered when determining the roughness Rz, and therefore the conditions of the surface cannot be well expressed by such roughness.

FIG. 1 is a schematic view illustrating independent projected portions formed on the outermost layer of an example of the photoreceptor for use in the image forming apparatus of the present invention. In the present invention, the projected portions are defined as projections having a height of not lower than ½ of the ten-point mean roughness (Rz) included in the predetermined scanning length (i.e., 12 mm). The projected portions play a significant role in the cleanability of the photoreceptor.

It is preferable that the projected portions are independent from each other and the summit thereof is flat as illustrated in FIG. 1. In addition, it is preferable that the projected portions are polished or have a smooth surface. Further, the base of the projected portions is preferably smooth (i.e., the projected portions are gently sloped). As illustrated in FIG. 1, a ground (groove) may be present around the projected portions to separate the projected portions from each other.

Figure 2:
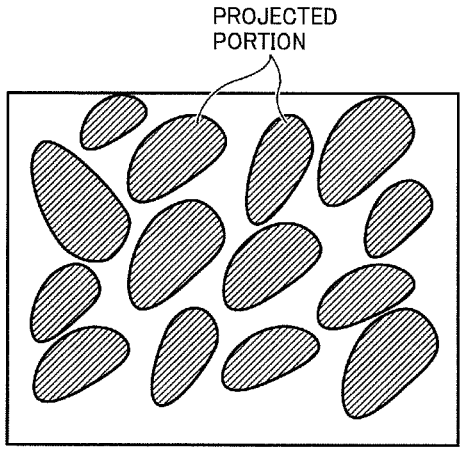
FIG. 2 is a schematic cross section (plan view) of the projected portions of a photoreceptor for use in the image forming apparatus of the present invention, wherein the projected portions are cut at a plane having a height of Rz/2.

FIG. 2 is a schematic cross section (plan view) of the projected portions of an example of the photoreceptor for use in the image forming apparatus of the present invention, wherein the projected portions are cut at a plane having a height of Rz/2 from the surface of the outermost layer. Therefore, the outline of a portion illustrated by the slanted lines in FIG. 2 is not the line of the base of the projected portion. The shape of cross sections (illustrated by slanted lines) of the projected portions is not particularly limited. In addition, the projected portions may be regularly arranged or randomly arranged.

When the profile of the surface of a photoreceptor is obtained, the scanning direction is not particularly limited. For example, when the photoreceptor is a cylindrical photoreceptor, the scanning direction may be a circumferential direction, a direction (hereinafter referred to as axis direction) parallel to the axis of the photoreceptor, or another direction between the circumferential direction and the axis direction. However, in consideration of the shape of the table of the surface roughness tester, the scanning direction is preferably the axis direction.

The height of a projected portion is the distance between the summit of the projected portion and the base line of the profile. In a profile (such as profile illustrated in FIG. 13A), there is a case where a peak in the profile is recorded by scanning a portion of a projected portion other than the summit thereof. However, when the number of projected portions is counted, the number of all peaks is counted because even if the scanned portion is not the summit, the summit is considered to be present near the scanned portion.

In the present invention, the number of projected portions having a height of not less than Rz/2 is counted. This is because the number of projected portions can be better estimated by this method than the method in which the number of peaks having a height of not lower than Rz is counted.

Since the outermost layer of a photoreceptor is typically waved, it is preferable that the height of projected portions includes the waviness (displacement) of the outermost layer. Specifically, the height of peaks is determined on the basis of the deepest valley in the profile in the scanning length of 12 mm.

In the present invention, it is possible to count the number of projected portions present in a predetermined unit area to determine the density of the projected portions in the unit area. The unit area is determined depending on the size and shape of the projected portions, and is generally from 100 μm×100 μm square to 15 mm×15 mm square. When a spray coating is used for forming projected portions, the unit area is preferably from 1 mm×1 mm square to 15 mm×15 mm square. However, only limited instruments can be used for determining the density of the projected portions in a unit area, and in addition exclusive software is needed for determining the density of the projected portions. Namely, the density cannot be easily determined.

Therefore, in the present application, a surface roughness tester, which is easily available, is used for obtaining the profile of the outermost layer of a photoreceptor. Specifically, a scanning operation in a scanning length of 12 mm is repeated at least 4 times to determine the average number of projected portions having a height of not lower than Rz/2 present in a length of 12 mm of the profile. By using this method, the reliability of the measurements can be enhanced.

Next, the method for measuring the number of projected portions will be explained. At first, the surface roughness Rz (i.e., ten-point mean roughness) of the surface of the outermost layer of a photoreceptor is measured by the method defined in JIS B0601 (2001). In this application, a surface texture measuring instrument SURFCOM 1400D with a measuring head DT43801 (from Tokyo Seimitsu Co., Ltd.) is used as the surface roughness tester, but the surface roughness tester is not limited thereto. The surface of the photoreceptor is scanned with the instrument to obtain the profile of the surface. Next, the number of projected portions having a height of not lower than Rz/2 in a predetermined length (12 mm in this application) of the thus obtained profile curve (such as the curve illustrated in FIG. 13A) is counted to determine the density of projected portions. In this application, our own program is used for automatically measuring the height of projected portions in a profile curve, which is constituted of digital data. In this regard, waviness is added to the profile curve to prepare a roughness curve (such as the curve illustrated in FIG. 13B) and the number of projected portions having a height of not lower than Rz/2 in the predetermined length of the thus obtained roughness curve is counted. In this regard, the digital data of the roughness curve include data of about 30,000 points, but the data is thinned out to reduce the data size to 1/5. Thus, data of 7,680 points are obtained. Next, the thus obtained curve is analyzed to check the change in height of the curve. In this regard, it is defined that a projected portion is present at a peak having a height change of not lower than 40%. By using this method, the number of particularly high projected portions can be counted. The present inventors discover that whether or not a photoreceptor causes the above-mentioned toner passing problem can be well determined on the basis of the number of projected portions present on the surface of the photoreceptor, which have a height of not lower than Rz/2.

The measurement length is preferably changed depending on the method for forming the surface, the particle diameter of the toner used, and properties of the cleaning blade used, but is generally from 100 μm to 15 mm. When a spray coating method is used for forming projected portions, the measurement length is generally from 1 mm to 15 mm. In this application, when a spray coating method is used for forming projected portions, the number of projected portions in the measurement length of 12 mm is preferably from 40 to 90.

The present inventors performed the following experiment concerning the projected portions.

Specifically, projected portions were formed on a charge transport layer of a cylindrical layered photoreceptor by a spray coating method while changing the coating conditions. Thus, six photoreceptor drums having different surface conditions were prepared. The conditions of the spray coating were as follows.

(1) Spraying speed: 10 mm/sec (2) Number of rotations of photoreceptor: 200 rpm (3) Aperture of spray gun: 8 (number on a scale)

(4) Misting pressure: changed (the center value is 2 kgf/mm$^2$)

The profiles of randomly selected 4 points of the surface of each photoreceptor in the direction parallel to the axis of the photoreceptor were obtained. As a result, the profiles of the 4 points are almost the same. The ten-point mean roughness Rz (in units of μm) of each of the six photoreceptors is shown in Table 1. It is clear from Table 1 that each photoreceptor had no specific change in Rz. In addition, the number of projected portions having a height of not lower than Rz/2 in a measurement length of 12 mm is shown in Table 2.

TABLE 1

(Rz of photoreceptors in units of μm)

| | n = 1 (point 1) | n = 2 (point 2) | n = 3 (point 3) | n = 4 (point 4) | Average |
|---|---|---|---|---|---|
| Condition 1 (photoreceptor 1) | 6.429 | 6.116 | 5.819 | 6.612 | 6.244 |
| Condition 2 (photoreceptor 2) | 2.540 | 2.461 | 2.563 | 2.843 | 2.602 |
| Condition 3 (photoreceptor 3) | 3.249 | 3.515 | 3.605 | 3.509 | 3.470 |
| Condition 4 (photoreceptor 4) | 4.855 | 4.950 | 4.870 | 4.670 | 4.837 |
| Condition 5 (photoreceptor 5) | 4.002 | 4.112 | 3.964 | 4.536 | 4.154 |
| Condition 6 (photoreceptor 6) | 6.316 | 6.228 | 5.883 | 6.238 | 6.167 |

TABLE 2

(The number of projected portions)

| | n = 1 (point 1) | n = 2 (point 2) | n = 3 (point 3) | n = 4 (point 4) | Average |
|---|---|---|---|---|---|
| Condition 1 (photoreceptor 1) | 59 | 59 | 45 | 55 | 54.5 |
| Condition 2 (photoreceptor 2) | 58 | 51 | 35 | 49 | 48.3 |
| Condition 3 (photoreceptor 3) | 79 | 68 | 70 | 59 | 69.0 |
| Condition 4 (photoreceptor 4) | 75 | 75 | 77 | 86 | 78.3 |
| Condition 5 (photoreceptor 5) | 62 | 50 | 48 | 54 | 53.5 |
| Condition 6 (photoreceptor 6) | 55 | 61 | 54 | 55 | 56.3 |

This experiment did not bring singular measurement results such that only the valleys are detected or only the summits of projected portions are detected. Therefore, the average number of projected portions determined from the profile curve of a photoreceptor is considered to represent the number of real projected portions randomly arranged on the surface of the photoreceptor.

In this application, projected portions are defined as projections having a height of not lower than Rz/2 in a profile curve obtained by scanning the surface of a photoreceptor with a surface roughness tester. The method for forming projected portions on a photoreceptor is not particularly limited. For, example, the below-mentioned methods, and known methods can be used. The methods are broadly classified into (1) methods in which a projection forming liquid is misted to adhere the droplets to the surface of a photoreceptor; and (2) methods in which the outermost layer of a photoreceptor is partially destroyed by applying a mechanical or thermal energy thereto.

Specific examples of the methods (1) include spray coating methods, inkjet coating methods, and printing methods. Specific examples of the methods (2) include molding methods using a female die, and laser abrasion methods in which grooves are formed around a (projected) portion using a mask. Both of the methods (1) and (2) can be used for the present invention, but the methods (1) are preferably used because of hardly causing distortion in the photoreceptor. Namely, the methods (2) are inferior to the methods (1) because the outermost layer is partially destroyed When distortion is caused, thermal annealing may be performed on the distorted photoreceptor.

Figure 3:
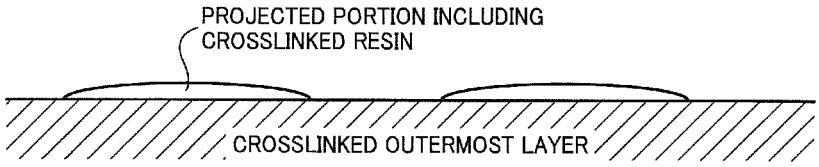
FIG. 3 is a schematic cross section of a photoreceptor for explaining the projected portions thereon.

The present inventors confirmed that projected portions formed by a spray coating method have a bell shape (namely, a shape like parabola) when the projected portions are observed with a laser microscope in a vertical/horizontal magnification ratio of 50/1. Thus, spray coating methods are considered to form projections having a specific form. FIG. 3 is a schematic view illustrating projected portions formed by a spray coating method, wherein the projected portions are illustrated in a horizontal/vertical magnification ratio of about 1/1.

The surface, on which independent projected portions are formed, for use in the present invention is different from a surface disclosed in a background art JP-A 2007-233359, on which a number of minor recessed portions are formed, or another surface disclosed in the background art and having well-form projected and recessed portions.

The photoreceptor for use in the present invention has the following advantages. Specifically, since a cleaning blade, which is made of an elastic material, is contacted with the summits of a number of projected portions formed on the surface of the photoreceptor, the blade can be smoothly slid because of being supported by the number of projected portions. In addition, grooves (i.e., "ground" illustrated in FIG. 1) are connected with each other (i.e., the projected portions are substantially independent of each other), foreign materials present on the surface can be easily removed therefrom. In addition, even when one of the projected portions is destroyed, the other projected portions are hardly damaged because the projected portions are substantially independent of each other. Further, a surface having projections including an inorganic filler tends to chip the tip of a cleaning blade because the inorganic filler has a high hardness and strongly resists the moving blade. Therefore, it is preferable that the projected portions do not include a hard inorganic filler. The surface having such projected portions for use in the present invention can solve the problems mentioned above better than conventional surfaces having a number of recessed portions thereon.

The projected portions formed on the surface of the photoreceptor preferably has a proper height, and are generally not higher than 7 μm, and preferably not higher than 5 μm. When the projected portions are higher than 7 μm, residual toner particles tend to easily pass through the gap between the cleaning blade and the surface of the photoreceptor. Therefore, the height of the projected portions is preferably determined depending on the particle diameter of the toner used.

The image forming apparatus of the present invention includes a photoreceptor on which projected portions including a crosslinked charge transporting material are located in predetermined numbers of from 40 to 90 in a length of 12 mm. Therefore, the projected portions have a high strength. Accordingly, the surface of the photoreceptor has good resistance to cleaning blades. It is preferable that the projected portions have a crosslinking density so as not to be dissolved in solvents such as tetrahydrofuran and toluene and a resistance to frictional force of cleaning blades.

Cleaning blades are typically made of an elastic material such as hard rubbers (e.g., polyurethane rubbers) and have a plate form. For example, when such a cleaning blade is contacted with the surface of the photoreceptor so as to counter the rotated photoreceptor, toner particles remaining on the surface of the photoreceptor are scraped off by the cleaning blade. In this case, it is considered that the tip portion of the cleaning blade causes microscopic vibrations (i.e., sticking and slipping of the tip portion) due to friction with the surface of the photoreceptor, and it is preferable that the cleaning blade stably causes such microscopic vibrations. In this regard, the conditions of the vibrations change depending on the properties of the cleaning blade and the surface of the photoreceptor. It is considered that by contacting a cleaning blade with the surface of the photoreceptor having such projected portions as mentioned above, such microscopic vibrations can be stably caused. Namely, cleaning blades can stably slide on the surface of the photoreceptor having such projected portions as mentioned above over a long period of time.

The projected portions on the photoreceptor can be observed with an instrument such as laser microscopes, optical microscopes, electron microscopes, and atom force microscopes. Specific examples of the laser microscopes include a 3D profile microscope VK-8550 from Keyence Corporation, SURFACE EXPLORER SX-520DR from Ryoka Systems Inc., and a confocal laser scanning microscope OLS3000 from Olympus Corporation. Specific examples of the optical microscopes include a digital microscope VHX-500 from Keyence Corporation, and 3D digital microscope VC-7700 from Omron Corporation. Specific examples of the electron microscopes include a 3D real surface view microscope VE-9800 from Keyence Corporation, and a scanning electron microscope SUPERSCAN SS-550 from Shimadzu Corporation. Specific examples of the atom force microscopes include a scanning probe microscope SPM-9600 from Shimadzu Corporation. By using such microscopes, conditions of the projected portions such as shape of the projected portions and the summit thereof, conditions of the bases of the projected portions, arrangement of the projected portions, and height of the projected portions can be determined.

Figure 4:
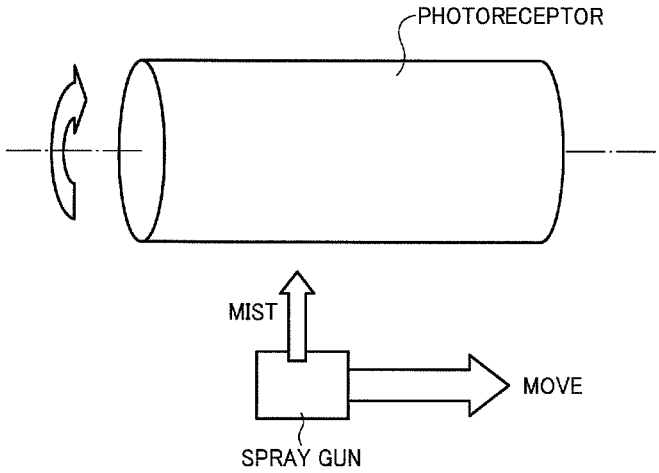
FIG. 4 illustrates a spray coating device for forming projected portions on the surface of a photoreceptor.

The method for forming projected portions on the surface of the photoreceptor is not particularly limited, and any methods (such as the methods mentioned above) can be used as long as the above-mentioned requirements for the projected portions can be satisfied. Among the methods, spray coating methods in which a coating liquid is sprayed to the surface of the photoreceptor using a spray gun as illustrated in FIG. 4 are preferable. Next, the spray coating method will be explained in detail.

Any known spray coating methods can be used for forming projected portions. FIG. 4 illustrates a spray coating device.

At first, the photoreceptor is rotated by a driving device (not shown) at a predetermined speed. Next, a coating liquid and a gas are supplied to a spray gun while moving (oscillating) the spray gun in the direction parallel to the axis of the photoreceptor to spray mists of the coating liquid to the surface of the photoreceptor, resulting in formation of coated films (i.e., projected portions). The conditions of the projected portions depend on the coating conditions such as viscosity of the coating liquid, concentration of the solvent included in the coating liquid, rotation speed of the photoreceptor, oscillating speed of the spray gun, shape of the nozzle of the spray gun, and pressure and flow rate of the supplied gas.

Next, the photoreceptor for use in the image forming apparatus of the present invention will be explained.

The photoreceptor includes at least a substrate, a photosensitive layer located on the substrate, and a crosslinked outermost layer located on the photosensitive layer, on which a number of crosslinked projected portions are formed.

The photosensitive layer is not particularly limited, and is a single-layer photosensitive layer including both a charge generation material and a charge transport material, or a functionally separated multilayer photosensitive layer in which a charge generation layer and a charge transport layer are overlaid. However, a photoreceptor having a functionally separated multilayer photosensitive layer is preferably used for the image forming apparatus of the present invention. In this regard, the positions of the charge generation layer and the charge transport layer are not particularly limited, and both a normal multilayer photosensitive layer in which a charge transport layer is formed on a charge generation layer and a reverse multilayer photosensitive layer in which a charge generation layer is formed on a charge transport layer can be used.

Figure 5:
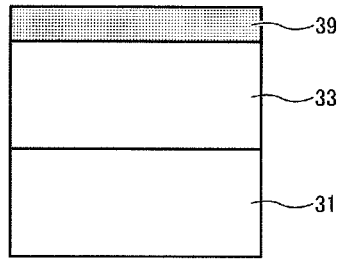
FIGS. 5-7 illustrate the layer structure of photoreceptors for use in the image forming apparatus of the present invention.
Figure 6:
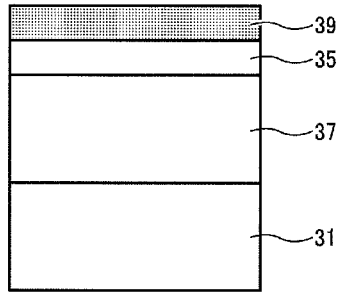
Figure 7:
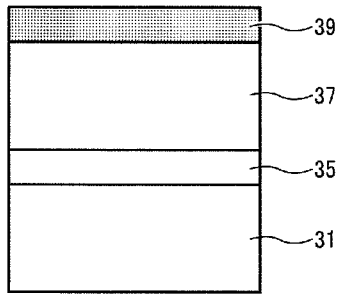

FIGS. 5-7 illustrate layer structures of photoreceptors for use in the image forming apparatus of the present invention.

The photoreceptor illustrated in FIG. 5 includes a substrate 31, a single-layered photosensitive layer 33 located on the substrate, and an outermost layer 39 located on the photosensitive layer.

The photoreceptor illustrated in FIG. 6 includes the substrate 31, a reverse multilayer photosensitive layer located on the substrate, which includes a charge transport layer 37 and a charge generation layer 35 located on the charge transport layer 37, and the outermost layer 39 located on the charge generation layer 35.

The photoreceptor illustrated in FIG. 7 includes the substrate 31, a normal multilayer photosensitive layer located on the substrate, which includes the charge generation layer 35 and the charge transport layer 37 located on the charge generation layer 35, and the outermost layer 39 located on the charge transport layer 37.

In addition, on the surface of the outermost layer 39, projected portions are formed.

Any known electroconductive materials can be used for the substrate 31. For example, substrates of metals such as iron, copper, gold, silver, aluminum, zinc, titanium, lead, nickel, tin, antimony, indium, chromium, aluminum alloys, and stainless steel can be used. In addition, metal substrates and plastic substrates, on which a layer of aluminum, aluminum alloy, or indium oxide-tin oxide is formed using a vacuum evaporation method can also be used. Further, substrates such as plastics and papers, in which particles of an electroconductive material such as carbon blacks, tin oxide, titanium oxide and silver are dispersed optionally together with a binder resin can also be used. Furthermore, plastic substrates including an electroconductive resin can also be used.

The surface of the substrate may be subjected to a treatment such as cutting treatments, roughening treatments, and alumite treatments to prevent formation of interference fringes (i.e., moiré) when a light irradiating process is performed using a laser beam.

An undercoat layer can be formed between the substrate and the photosensitive layer to prevent formation of interference fringes (i.e., moiré) and to cover up flaws of the substrate.

The undercoat layer is typically prepared by applying an electroconductive layer coating liquid including a binder resin and a carbon black, or a particulate material or a pigment, which has a proper electroconductivity. The coating liquid may include a crosslinkable compound. Further, the surface of the undercoat layer may be roughened. The thickness of the undercoat layer is preferably from 0.2 μm to 20 μm, and more preferably from 5 μm to 10 μm.

Specific examples of the binder resin for use in the undercoat layer include known resins such as polymers and copolymers of vinyl compounds (e.g., styrene, vinyl acetate, vinyl chloride, acrylate, methacrylate, vinylidene fluoride, and trifluoroethylene), polyvinyl alcohol, polyvinyl acetal, polycarbonate, polyester, polysulfone, polyphenylene oxide, polyurethane, cellulose resins, phenolic resins, melamine resins, silicone resins, and epoxy resins.

Specific examples of the electroconductive particles and pigments include particles of metals and metal alloys such as aluminum, zinc, copper, chromium, nickel, silver and stainless steel, and particulate plastics on which a layer of one or more of the above-mentioned metals and metal alloys is formed by a vacuum evaporation method. In addition, metal oxides such as zinc oxide, titanium oxide, tin oxide, antimony oxide, indium oxide, bismuth oxide, indium oxide doped with tin, and tin oxide doped with antimony or tantalum can also be used. These materials can be used alone or in combination. When two or more of the materials are used in combination, mixtures thereof, solid dispersions thereof and materials in which the materials are fused together can be used.

A blocking layer (i.e., a charge injection preventing layer), which has a barrier function and/or an adhesive function, can be formed between the substrate and the undercoat layer. Namely, the blocking layer is formed to reduce charge injection from the substrate and to prevent the photosensitive layer from electrically damaging.

Specific examples of the materials for use in the blocking layer include polyvinyl alcohol, poly-N-vinyl imidazole, polyethylene oxide, ethyl cellulose, ethylene-acrylic acid copolymers, casein, polyamide, N-methoxymethylated 6-nylon, nylon copolymers, etc. The blocking layer is typically prepared by applying a coating liquid which is prepared by dissolving one or more of these materials in a solvent, and then drying the coated liquid.

The thickness of the blocking layer is preferably from 0.05 to 7 μm, and more preferably from 0.1 to 2 μm.

Next, the photosensitive layer will be explained. The photosensitive layer includes a charge generation material. Specific examples of the charge generation materials include pyrylium dyes, thiopyrylium dyes, phthalocyanine pigments having crystal forms such as α-form, β-form, γ-form, and ε-form and including for which various metals can be used, anthanthrone pigments, dibenzpyrenequinone pigments, pyranthrone pigments, azo pigments such as monoazo, disazo and trisazo pigments, indigo pigments, quinacridone pigments, asymmetric quinocyanine pigments, quinocyanine pigments, amorphous silicone, etc. These charge generation materials can be used alone or in combination.

The photosensitive layer further includes a charge transport material. Specific examples of the charge transport materials include pyrene compounds, N-alkylcarbazole compounds, hydrazone compounds, N,N-dialkylaniline compounds, diphenylamine compounds, triphenylamine compounds, triphenyl methane compounds, pyrazoline compounds, styryl compounds, stilbene compounds, etc.

In the case of a multilayer photosensitive layer including a charge generation layer and a charge transport layer, the charge generation layer is typically prepared by the following method. Specifically, a charge generation material, a binder resin, whose weight is 0.3 to 4 times the weight of the charge generation material, and a solvent are mixed, and the mixture is subjected to a dispersion treatment using a dispersing device such as homogenizers, ultrasonic dispersing devices, ball mills, vibration mills, sand mills, attritors, and roll mills.

The thus prepared dispersion is applied, followed by drying, resulting in formation of a charge generation layer. Alternatively, a charge generation layer may be formed by an evaporation method.

The charge transport layer is typically prepared by applying a coating liquid which is prepared by dissolving a charge transport material and a binder resin in a solvent, and then drying the coated liquid. In this regard, when a charge transport material having good film formability is used, the coating liquid may be prepared by dissolving only the charge transport material in a solvent without using a binder resin.

Specific examples of the materials for use as the binder resin include polymers and copolymers of vinyl compounds (such as styrene, vinyl acetate, vinyl chloride, acrylate, methacrylate, vinylidene fluoride, and trifluoroethylene), polyvinyl alcohol, polyvinyl acetal, polycarbonate, polyester, polysulfone, polyphenylene oxide, polyurethane, cellulose resins, phenolic resins, melamine resins, silicone resins, and epoxy resins.

The thickness of the charge generation layer is preferably not greater than 5 μm, and more preferably from 0.1 to 2 μm.

The thickness of the charge transport layer is preferably from 5 to 50 μm, and more preferably from 10 to 35 μm.

In the photoreceptor of the present invention, the crosslinked outermost layer and the crosslinked projected portions preferably have continuity (such as electric continuity and mechanical continuity), i.e., the crosslinked projected portions are preferably integrated with the outermost layer. In order that the crosslinked outermost layer and the crosslinked projected portions have electric continuity and mechanical continuity, they preferably have continuity in formulation. Specifically, it is preferable that the crosslinked outermost layer and the crosslinked projected portions include the same crosslinked charge transport material at the same content. For example, when the crosslinked outermost layer includes a crosslinked material having the triarylamine structure (1) mentioned above, the crosslinked projected portions preferably include the crosslinked material at the same content.

When the charge transport material used for the projected portions is different from that included in the outermost layer, the charge carriers tend to have energy gap, thereby causing electric deficiency. The difference in content of the charge transport material between the outermost layer and the projected portions is preferably within 10% by mole. When the difference in content is greater than the range, it is not preferable in view of charge transporting, i.e., the residual potential of the photoreceptor increases. In addition, the method for crosslinking the outermost layer is preferably the same as the method for crosslinking the projected portions so that the outermost layer and the projected portions have continuity in physical properties.

In a conventional photoreceptor in which a coating liquid of an outermost layer having no crosslinking ability is applied on a layer which is not crosslinked, the charge transport material included therein is migrated in the drying process (because the lower layer is partially dissolved in the solvent included in the coating liquid), and thereby the layers have continuity. However, when a coating liquid is applied on a crosslinked outermost layer, which is hardly dissolved in the solvent), it is difficult for the layers to have continuity. Therefore, it is important for the photoreceptor for use in the present invention that the projected portions and the outermost layer thereof have continuity to produce the effects of the present invention.

Formation of projected portions is strongly influenced by the wettability of the crosslinked outermost layer. Specifically, when a coating liquid for forming projected portions is misted by a spray coating method to be applied on an outermost layer, which is not crosslinked, droplets on the surface of the outermost layer are mixed with the outermost layer, and thereby such projected portions as mentioned above for use in the present invention cannot be formed. Particularly, when the reactive monomer included in the coating liquid is liquid at room temperature, the film of the coated liquid on the outermost layer is liquid even if the solvent in the coating liquid is evaporated, and thereby the film is rapidly mixed with the outermost layer. Therefore, in order to prevent occurrence of such a mixing problem in the present invention, the coating liquid for forming the projected portions is preferably applied on a crosslinked outermost layer.

The coating liquid for forming the projected portions preferably includes a surfactant, and more preferably a reactive surfactant. For example, reactive silicone compounds having an acryloyloxy group at both end portions of the molecule are preferably used. In addition, other reactive surfactants can also be used. The content of a surfactant included in each of the coating liquids for forming the projected portions and the outermost layer is generally from 0.5 to 10% by weight based on the total weight of the solid components included in the coating liquid.

Known charge transport materials can be used for preparing an outermost layer, which can have continuity with the projected portions. In addition, chain-polymerizable compounds having a group such as acryloyloxy and styrene groups, and step-reaction polymerizable compounds having a group such as hydroxyl, alkoxysilyl and isocyanate groups can be used as the polymerization or crosslinking monomer or oligomer to be included in the outermost layer coating liquid. In view of the electrophotographic properties of the photoreceptor, flexibility in selection of materials of the photoreceptor, and preparation stability of the photoreceptor, combinations of a positive hole transporting compound and a chain-polymerizable compound are preferably used for the outermost layer coating liquid. More preferably, crosslinkable compounds having both a positive hole transporting group and an acryloyloxy group in a molecule thereof are used therefor. In this case, the coated layer is crosslinked using heat, light or radiation rays. In this regard, it is preferable that the outermost layer is crosslinked three-dimensionally.

The outermost layer of the photoreceptor for use in the present invention is preferably a charge transport layer constituted of a crosslinked (or hardened) resin. Crosslinked projected portions are formed on such a crosslinked charge transport layer. Suitable materials for use in preparing such a crosslinked resin to be included in the projected portions and the charge transport layer include compounds having a charge transport structure and one or more (meth)acryloyloxy groups.

In this regard, compounds having no charge transport structure and one or more (meth) acryloyloxy groups may be used in combination therewith. When preparing the crosslinked charge transport layer and the projected portions using a coating liquid including such a compound, the coating liquid is applied (or sprayed) and then energy such as heat, light and radiation rays is applied thereto to crosslink the layer or projected portions.

Suitable materials for use as the compounds having a charge transport structure for use in the charge transport layer and the projected portions include compounds having a triarylamine structure. More preferably, compounds having a triarylamine structure and at least one radically polymerizable mono-functional group are used so that the compounds can be reacted with the binder resin to form a crosslinked network.

For example, charge transport materials having the following formula (1) are preferably used.

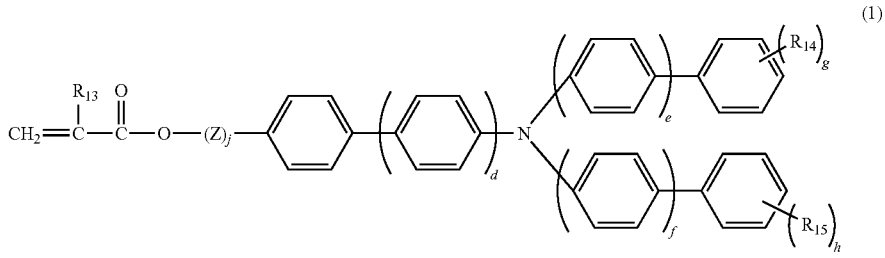

(1)

wherein each of d, e and f is 0 or 1; each of g and h is 0 or an integer of from 1 to 3; $R_{13}$ represents a hydrogen atom or a methyl group; each of $R_{14}$ and $R_{15}$ represents an alkyl group having from 1 to 6 carbon atoms, wherein when g is 2 or 3, the groups $R_{14}$ may be the same or different from each other, and when h is 2 or 3, the groups $R_{15}$ may be the same or different from each other; Z is a methylene group, an ethylene group or one of the following groups:

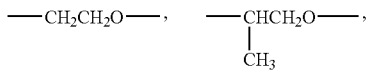

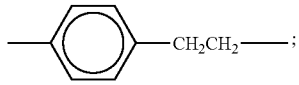

and j is 0 or 1

Specific examples of the compounds having formula (1) are as follows.

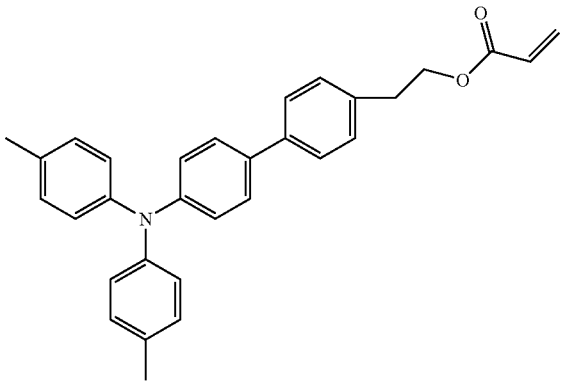

(2-[4'-(di-p-tolyl-amino)biphenyl-4-yl]ethyl acrylate)

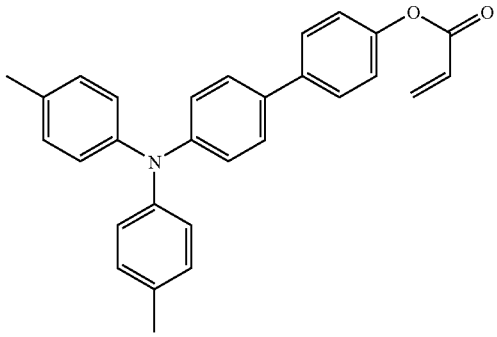

(2-[4'-(di-p-tolyl-amino)biphenyl-4-yl]acrylate)

The thickness of the crosslinked resin layer (serving as a charge transport layer) is preferably from 5 to 50 μm, and more preferably from 10 to 35 μm similarly to the above-mentioned charge transport layer.

When the resin layer is a second charge transport layer or a protective layer, the thickness of the resin layer is from 0.1 to 20 μm, and more preferably from 1 to 10 μm. When a number of projected portions are present on the surface of the outermost layer, the thickness of the outermost layer cannot be well determined. Therefore, it is preferable to use a thickness meter utilizing eddy current (such as FISCHER SCOPE MMS from Fischer Instruments K.K.) because the influence of the projected portions on the thickness can be reduced. In this regard, the thicknesses of the outermost layer at randomly selected four points are measured with the instrument, and the thickness data are averaged to determine the thickness of the layer.

As mentioned above, the photoreceptor for use in the image forming apparatus of the present invention has an outermost layer having good abrasion resistance and specific projected portions located on the surface of the outermost layer. In conventional photoreceptors having good abrasion resistance, the surface of the photoreceptors is hardly abraded, namely, the surface is hardly renewed. Therefore, foreign materials such as toner particles and paper dust and contaminants such as ionized materials caused by acidic gases such as NOx tend to accumulate thereon, thereby causing problems such that the cleaning blade is not smoothly slid on the surface of the photoreceptor, and the tip of the blade is vibrated, twisted and/or reversed, resulting in deterioration of the cleanability of the blade or chipping of the tip of the blade, thereby deteriorating the image qualities. Since the photoreceptor for use in the present invention has such an improved surface as mentioned above, occurrence of the problems can be prevented.

Next, the image forming apparatus of the present invention will be explained by reference to drawings. However, the image forming apparatus of the present invention is not limited to the illustrated examples.

Figure 8:
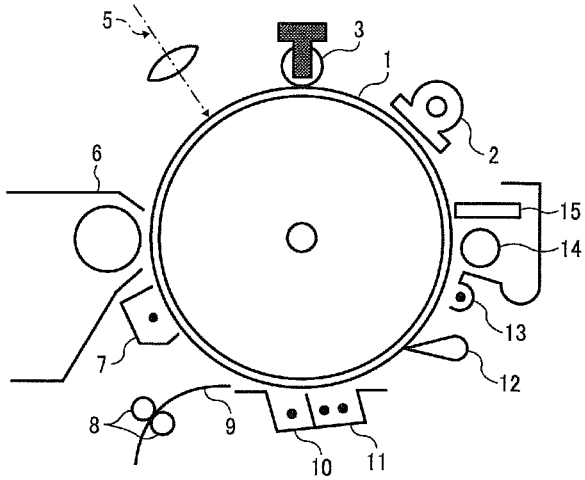
FIG. 8 is a schematic view illustrating an example of the image forming apparatus of the present invention.

FIG. 8 is a schematic view for explaining the image forming apparatus of the present invention.

Referring to FIG. 8, a photoreceptor 1 is the photoreceptor mentioned above for use in the image forming apparatus of the present invention. Although the photoreceptor 1 has a drum form, photoreceptors having a sheet form or an endless belt form can also be used.

The image forming apparatus further includes a charging device 3 configured to charge the photoreceptor 1; a light irradiating device configured to irradiate the charged photoreceptor 1 with an imagewise light beam 5 to form an electrostatic latent image on the photoreceptor; a developing device 6 configured to develop the electrostatic latent image with a developer including a toner to form a toner image on the photoreceptor; a pre-transfer charger configured to charge the toner image so that the toner image can be well transferred; a transfer device (i.e., a combination of a transfer charger 10 and a separation charger 11 in FIG. 8), which is configured to transfer the toner image onto a receiving material 9, which is timely fed by a pair of registration rollers 8; a separation pick 12 configured to separate the receiving material 9 bearing the toner image thereon from the photoreceptor 1; a cleaning device for cleaning the surface of the photoreceptor 1, which includes a pre-cleaning charger 13 configured to charge residual toner on the photoreceptor so that the residual toner can be well removed, a cleaning brush 14 configured to remove the residual toner from the photoreceptor, and a cleaning blade 15 configured to scrape the residual toner off the photoreceptor; and a discharging lamp 2 configured to irradiate the photoreceptor to decay charges remaining on the photoreceptor even after the cleaning process.

The charging device 3 is configured to charge the photoreceptor 1. Specific examples of the charging device 3 include non-contact chargers such as corotron chargers, scorotron chargers and solid state chargers; and contact chargers such as charging rollers and charging brushed.

Figure 9:
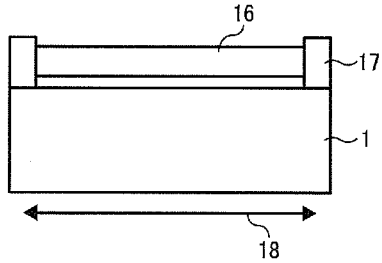
FIG. 9 is a schematic view illustrating a charging device for use in the image forming apparatus of the present invention.

In addition, short range chargers in which a charging roller 16 is opposed to the photoreceptor 1 with a small gap therebetween in an image forming area 18 as illustrated in FIG. 9 can be preferably used. When a charging roller is contacted with the surface of a photoreceptor while a lubricating material is applied to the surface, it is possible that contamination of the charging roller is accelerated by the lubricating material adhered to the charging roller. Contamination of the charging roller causes uneven charging and acceleration of contamination of the photoreceptor. By using such a short range charger as illustrated in FIG. 9, occurrence of such problems can be prevented.

The method for forming a small gap between the charging member 16 and the photoreceptor 1 is as follows:

(1) A gap forming member 17 is provided on both edge portions of the charging member 16 as illustrated in FIG. 9;

(2) A gap forming member is provided on both edge portions of the photoreceptor; and (3) A gap forming member is provided on the flanges set on both edge portions of the photoreceptor.

In the present invention, all the methods (1)-(3) can be used. The gap forming member 17 should be insulating while having good abrasion resistance. The shape of the gap forming member 17 is not particularly limited, and for example gap forming members with tape form, seal form or tube form can be used.

The gap between the surface of the charging member 16 and the surface of the photoreceptor 1 is preferably from 10 μm to 200 μm, more preferably from 20 μm to 100 μm, and even more preferably from 40 μm to 80 μm. When the gap is smaller than the range, a problem in that the charging member and the photoreceptor contact with each other occurs. In this case, the advantages of the short range charger cannot be obtained, and in addition the image qualities deteriorate. In contrast, when the gap is larger than the range, stability of charging deteriorates and uneven charging tends to be performed. In this regard, by using a DC voltage superimposed with an AC component, the uneven charging problem can be avoided, resulting in prevention of deterioration of the image density and the contrast of images.

Referring to FIG. 8, a light irradiating device (not shown) irradiates the charged photoreceptor 1 with the imagewise light beam 5 to form an electrostatic latent image on the surface of the photoreceptor. Specific examples of the light source of the light irradiating device include fluorescent lamps, tungsten lamps, halogen lamps, mercury lamps, light emitting diodes (LEDs), laser diodes (LDs), electroluminescence (EL) devices, etc. In order to irradiate the photoreceptor 1 with a light beam having a wavelength in a desired wavelength range, filters such as sharp cut filters, band pass filters, near infrared cut filters, dichroic filters, interference filters, color conversion filters, etc., can be used.

The developing device 6 develops the electrostatic latent image formed on the photoreceptor 1 to form a visual image on the photoreceptor. Specific examples of the developing method include dry developing methods such as one component developing methods and two component developing methods, which use a dry toner, and wet developing methods using a liquid toner.

When the photoreceptor 1 is charged positively (or negatively), followed by light irradiating, a positive (or negative) electrostatic latent image is formed on the surface of the photoreceptor. When the positive (or negative) electrostatic latent image is developed with a negative (or positive) toner, a positive image can be obtained. In contrast, when the positive (or negative) electrostatic latent image is developed with a positive (or negative) toner, a negative image can be obtained.

Figure 10:
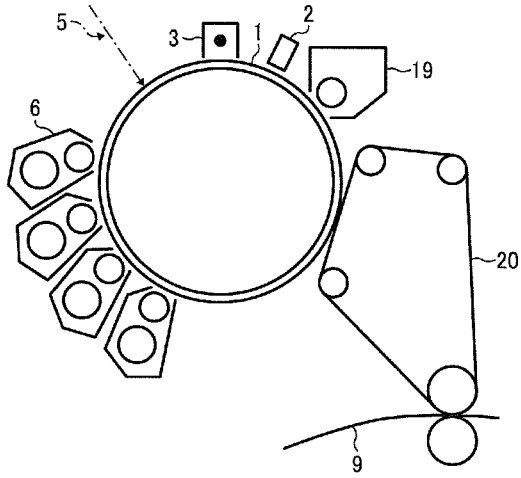
FIGS. 10 and 11 are schematic views illustrating other examples of the image forming apparatus of the present invention.
Figure 11:
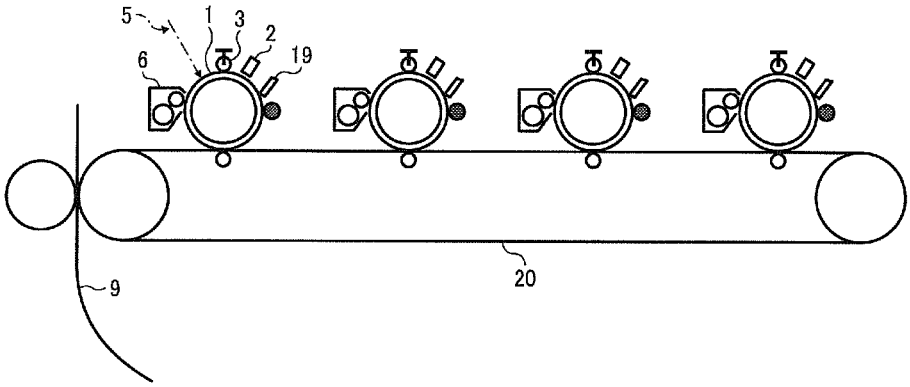

When full color images are formed, the developing device 6, includes at least a developing unit capable of forming yellow, magenta, cyan and black color images. Specific examples of the full color developing device include (1) a developing device in which four color developing units (i.e., yellow, magenta, cyan and black color developing units) are arranged around the photoreceptor 1 (as illustrated in FIG. 10); (2) a developing device having a developing unit in which four color toners are separately contained; (3) a revolver developing device in which four color developing units revolve such that one of the developing units is opposed to the photoreceptor; and (4) a tandem developing device in which four color developing units are arranged side by side so as to be opposed to the respective photoreceptors as illustrated in FIG. 11.

The toner used for the developing device 6 is not particularly limited, and any toners such as pulverization toners prepared by a pulverization method and polymerization toners prepared by a polymerization method can be used. In order to produce high quality images, polymerization toners are preferably used. It is well known that polymerization toners have spherical or approximately spherical forms. Since such toners have good releasability, the transfer rate of toner images is improved, and thereby the amount of residual toner on the surface of the photoreceptor can be reduced, resulting in prevention of formation of abnormal images such as images with background fouling. However, spherical or approximately spherical toners present on the surface of a photoreceptor cannot be well removed with a cleaning blade. Therefore, it is difficult to use spherical or approximately spherical toners for conventional image forming apparatus because the toners have such a disadvantage. Therefore, it is difficult for such conventional image forming apparatus to transfer toner images at high toner transfer efficiency.

In contrast, since specific micro projected portions are formed on the surface of the photoreceptor of the image forming apparatus of the present invention, the releasability and cleanability of the photoreceptor can be dramatically improved. Specifically, by increasing the linear pressure of the cleaning blade contacted with the projected portions on the photoreceptor, movement of spherical or approximately spherical toner, which can easily roll on the surface of the photoreceptor, can be prevented, and thereby toner particles remaining on the photoreceptor can be easily removed with the cleaning blade.

The thus prepared toner image on the photoreceptor 1 is transferred onto a receiving material such as paper sheets optionally via an intermediate transfer medium.

In a tandem image forming apparatus having an intermediate transfer medium 20, which is illustrated in FIG. 11, the photoreceptors 1, each of which is the photoreceptor mentioned above for use in the present invention, are contacted with the intermediate transfer medium 20. Therefore, the photoreceptors 1 are not directly contacted with a receiving material such as paper sheets. In this regard, the intermediate transfer medium 20 can have a form such as endless belt forms, sheet forms and drum forms.

The toner images transferred onto the intermediate transfer medium 20 are transferred onto the receiving material 9 (in this case, a paper sheet is used as the receiving material 9) with a transfer device. Specific examples of the transfer device include known transfer devices such as electrostatic transfer devices (e.g., transfer chargers and bias rollers); mechanical transfer devices (e.g., adhesion transfer devices and pressure transfer devices); magnetic transfer devices; etc.

When a toner image is transferred from a photoreceptor to a receiving material (or an intermediate transfer medium), a large amount of toner particles remain on the surface of the photoreceptor if the photoreceptor has low releasability, resulting in formation of abnormal images (such as omissions of center portions of images) and deterioration of image qualities due to low transfer efficiency. By forming the specific projected portions on the surface of the photoreceptor as mentioned above, the releasability of the surface of the photoreceptor can be improved, and thereby the transfer efficiency can be improved while preventing formation of omissions of center portions of images (hereinafter referred to as image omissions). The intermediate transfer medium 20 is preferably used for the image forming apparatus of the present invention because the photoreceptor 1 is prevented from being contacted with paper sheets (namely, paper dust is prevented from adhering to the surface of the photoreceptor). When discharging-induced materials and/or external additives of the toner used for developing are adhered to the surface of the photoreceptor 1, they tend to attract paper dust and thereby the filming problem is easily caused. By using an intermediate transfer medium, chance of occurrence of the filming problem can be dramatically reduced.

In the tandem image forming apparatus illustrated in FIG. 11, color toner images formed on the respective photoreceptors 1 are primarily transferred onto the intermediate transfer medium 20 to form a combined color toner image thereon. The combined color toner image is secondarily transferred onto the receiving material 9. Thus, the toner images are transferred onto the receiving material 9 while the photoreceptor 1 is not directly contacted with the receiving material. Therefore, the photoreceptor has a long life and the image forming apparatus can produce high quality images. It is necessary for tandem image forming apparatus that change with time in degree of deterioration among the four photoreceptors is reduced as much as possible. Specifically, when the four photoreceptors 1 illustrated in FIG. 11 have largely different properties (such as abrasion loss and contamination degree), the image qualities (such as color reproducibility and resolution) of the resultant full color toner images deteriorate. Particularly, when image omissions are formed, the color reproducibility of the image deteriorates. Deterioration of color reproducibility is fatal to full color images.

In a case of tandem full color image forming apparatus having no intermediate transfer medium, influence of paper dust on the contamination of the photoreceptor is remarkable among contaminants such as discharging-induced materials, eternal additives of toner and paper dust. This is because the photoreceptors have to be contacted with a paper sheet until color toner images thereon are transferred onto the paper sheet although such image forming apparatus typically have a mechanism such that when only a black image is formed, the photoreceptors other than the photoreceptor for forming the black toner image are separated from the paper sheet so as not to be contacted with the paper sheet. However, a need for printing a black image in such image forming apparatus is few. Therefore, influence of paper dust on the contamination of the photoreceptor is remarkable, and it is preferable to use an intermediate transfer medium for such tandem image forming apparatus. By using the photoreceptor mentioned above for such tandem image forming apparatus having an intermediate transfer medium, images having a good combination of color reproducibility and resolution can be produced over a long period of time (i.e., the photoreceptor has high durability) with hardly causing the filming problem and a blurred image problem in that blurred images are formed due to contamination of the surface of the photoreceptor.

In order to remove residual toner particles from the surface of the photoreceptor 1, a fur brush, a cleaning blade or a combination thereof is used for the cleaning device. In the image forming apparatus of the present invention, not only the residual toner particles on the surface of the photoreceptor but also discharging-induced materials adhered thereto have to be removed therefrom. Therefore, a cleaning blade is preferably used for the cleaning device. Since micro projected portions are formed on the surface of the photoreceptor 1, the area of the surface of the photoreceptor contacted with the cleaning blade can be reduced, thereby preventing the surface of the photoreceptor from being excessively abraded while improving the cleanability of the photoreceptor. In addition, since discharging-induced materials are mainly present on the groove portions (i.e., "ground" in FIG. 1) formed around the projected portions, i.e., since the surface of the photoreceptor is separated into portions on which discharging-induced materials are present and other portions on which discharging-induced materials are hardly present, formation of blurred images can be prevented. Thereby, high quality images can be stably produced over a long period of time.

In FIGS. 10 and 11, numeral 19 denotes a cleaning device configured to clean the surface of the photoreceptor 1.

In order to impart good slipping property to the surface of the photoreceptor 1, a material including a lubricating component can be applied to the surface of the photoreceptor. Applying such a lubricating material improves the releasability and abrasion resistance of the photoreceptor, and prevents adhesion of foreign materials such as toner particles and paper dust to the surface of the photoreceptor. Any known lubricity-imparting materials can be used as the lubricating material, and silicone compounds, fluorine-containing compounds, and compounds having a long alkyl group can be preferably used.

Suitable silicone compounds include any known compounds having a silicon atom in the molecule thereof. Specific examples thereof include silicone resins, particulate silicone resins, and silicone greases.

Suitable fluorine-containing compounds include any known compounds having a fluorine atom in the molecule thereof. Specific examples thereof include polytetrafluoroethylene (PTFE), perfluoroethylene/perfluoroalkoxyethylene copolymer (PFA), polyvinylidene fluoride (PVDF), and fluorine-containing greases.

Suitable compounds for use as the compounds having along alkyl group include any known compounds having a long alkyl group in the molecule thereof. Among these compounds, zinc stearate is preferably used.

In addition, other lubricating materials such as polyolefin resins, paraffin waxes, fatty acid esters, graphite and molybdenum disulfide can also be used.

When a lubricating material is applied to the surface of a photoreceptor, the photoreceptor can maintain good releasability over a long period of time. However, it is difficult to control the weight of the applied lubricating material, and applying an excessive amount of lubricating material causes the filming problem and uneven abrasion of the surface of the photoreceptor, and produces abnormal images. In contrast, when such a lubricating material is applied to the surface of the photoreceptor mentioned above for use in the present, the material is mainly located in the groove portions of the surface. Therefore, a certain amount of lubricating material is present on the surface of the photoreceptor, resulting in maintenance of good lubricating property of the photoreceptor. Accordingly, the photoreceptor is prevented from being contaminated, resulting in prevention of occurrence of uneven abrasion and formation of abnormal images.

The method for applying such a lubricating material is not particularly limited. For example, a method in which a solid lubricating material is directly applied to the surface of the photoreceptor; a method in which a lubricating material is scraped with a brush and then the brush is contacted with the surface of the photoreceptor to transfer the lubricating material; and a method in which a lubricating material is included in the toner, can be used.

After the surface of the photoreceptor is cleaned, charges remaining on the surface of the photoreceptor are optionally removed by the discharging device 2. Suitable devices for use as the discharging device 2 include discharging lamps, and discharging chargers. The light sources mentioned above for use in the light irradiating device and the chargers mentioned above for use in the charging device 3 can be used as the discharging device 2.

In addition, the image forming apparatus includes a document reader configured to read the image of an original document, a receiving material feeding device configured to feed receiving material sheets one by one, a fixing device configured to fix the toner image on a receiving material sheet, and a discharging device configured to discharge a copy sheet bearing a fixed image thereon from the main body of the image forming apparatus. Known devices can be used for these devices.

The image forming process of the image forming apparatus of the present invention is not limited to the examples illustrated in FIGS. 8, 10 and 11. For example, light irradiation processes other than the light irradiation process, pre-cleaning light irradiation process and discharging process for decaying the residual charges on the photoreceptor can be performed. Specific examples thereof include a light irradiation process performed before the transfer process, and a pre-light irradiation process performed before the light irradiation process.

The above-mentioned image forming devices can be fixedly incorporated in an image forming apparatus such as copiers, facsimiles and printers, but the devices can be detachably attached to the image forming apparatus as a process cartridge.

Figure 12:
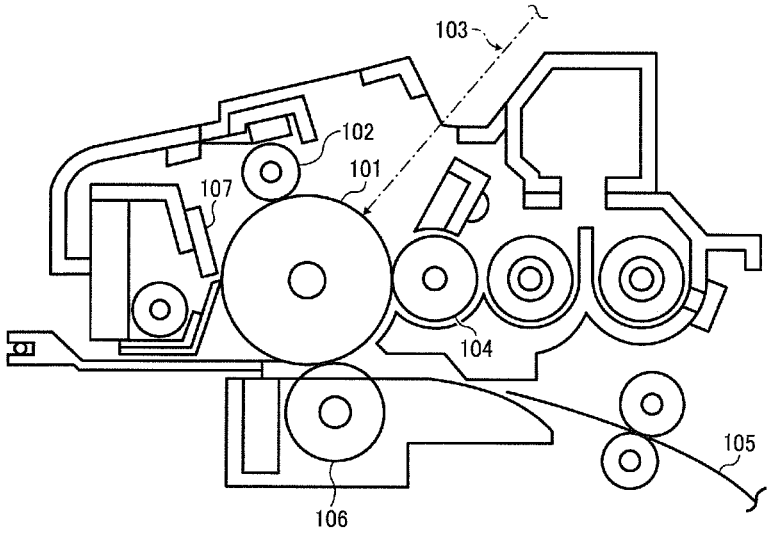
FIG. 12 is a schematic view illustrating a process cartridge for use in the image forming apparatus of the present invention.

FIG. 12 illustrates an example of the process cartridge for use in electrophotographic image forming apparatus. The process cartridge includes at least the photoreceptor mentioned above and a cleaning device having a cleaning blade, and optionally includes one or more of charging devices, developing devices, transferring devices, and discharging devices, wherein the devices are unitized so that the process cartridge can be detachably attached to an image forming apparatus.

In the present invention, the process cartridge includes the photoreceptor mentioned above and a cleaning device for cleaning the surface of the photoreceptor. The process cartridge is detachably attached to an image forming apparatus such as tandem image forming apparatus (illustrated in FIG. 11), image forming apparatus in which the photoreceptor is not directly contacted with a paper sheet serving as a receiving material, and combinations of these image forming apparatus.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Formation of Undercoat Layer

The following components were mixed and dispersed to prepare an undercoat layer coating liquid.

| | |
|---|---|
| Alkyd resin (BEKKOSOL 1307-60-EL from Dainippon Ink And Chemicals, Inc.) | 6 parts |
| Melamine resin (SUPER BEKKAMINE G-821-60 from Dainippon Ink And Chemicals, Inc.) | 4 parts |
| Titanium oxide (CR-EL from Ishihara Sangyo Kaisha Ltd.) | 40 parts |
| Methyl ethyl ketone | 50 parts |

The undercoat layer coating liquid was applied on a surface of an aluminum drum having an outside diameter of 30 mm, a length of 340 mm and a thickness of 0.8 mm using a dip coating method, and the coated liquid was dried. Thus, an undercoat layer having a thickness of 3.5 μm was prepared. In this regard, the thickness of the undercoat layer was measured with an eddy current thickness meter, and the thickness data of randomly selected five points in the axis direction of the photoreceptor were averaged. The thickness measuring operation was performed before and after formation of the undercoat layer to determine the thickness of the undercoat layer.

(Formation of Charge Generation Layer)

The following components were mixed to prepare a charge generation layer coating liquid.

| | |
|---|---|
| Polyvinyl butyral resin (XYHL from Union Carbide Corporation) | 0.5 parts |
| Cyclohexanone | 200 parts |
| Methyl ethyl ketone | 80 parts |
| Bisazo pigment having the following formula | 2.5 parts |

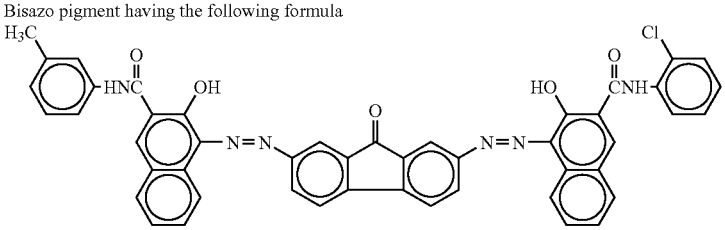

The charge generation layer coating liquid was applied on the undercoat layer by a dip coating method, and the coated liquid was heated to be dried. Thus, a charge generation layer having a thickness of 0.2 μm was prepared.

(Formation of Charge Transport Layer)

The following components were mixed to prepare a charge transport layer coating liquid.

| | |
|---|---|
| Bisphenol Z-form polycarbonate | 10 parts |
| Low molecular weight charge transport material having the following formula | 10 parts |

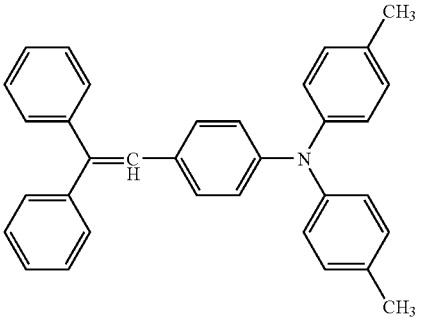

| | |
|---|---|
| Tetrahydrofuran | 80 parts |
| 1% tetrahydrofuran solution of silicone oil (Silicone oil: KF50-100CS from Shin-Etsu Chemical Co., Ltd.) | 0.2 part |

The charge transport layer coating liquid was applied on the charge generation layer by a dip coating method, and the coated liquid was heated to be dried. Thus, a charge transport layer having a thickness of 22 μm was prepared.

(Formation of Crosslinked Outermost Layer)

The following components were mixed to prepare an outermost layer coating liquid.

| | |
|---|---|
| Trimethylolpropane triacrylate (KAYARAD TMPTA from Nippon Kayaku Co., Ltd., which includes three functional groups, and has a molecular weight of 382 and a ratio (MW/F) of molecular weight (MW) to the number (F) of functional groups of 99 (i.e., 382/3) and which serves as a tri- or more-functional radically polymerizable monomer having no charge transport structure) | 9 parts |

-continued

| | |
|---|---|
| 2-[4'-(di-p-tolyl-amino)biphenyl-4-yl]ethyl acrylate (having the formula mentioned above and serving as a radically polymerizable monomer having a charge transport structure) | 9 parts |

The outermost layer coating liquid was applied on the surface of the charge transport layer using a spray gun from Olympos. The coating conditions were as follows.

Pressure: 1.5 kgf/mm$^2$

Discharge rate of the coating liquid: 8 g/min

Coating time: 60 seconds

Revolution of rotated (photoreceptor) drum: 40 rpm

Oscillating speed: 2.7 mm/sec

After the coating liquid was applied on the charge transport layer, the coated liquid was exposed to UV rays emitted by a metal halide lamp, which was set at a location 120 mm apart from the surface of the (photoreceptor) drum, while the aluminum drum was rotated at a revolution of 25 rpm so that the outermost layer was crosslinked. In this regard, the illuminance of the outermost layer was 600 mW/cm$^2$ when measured with an ultraviolet integrating actinometer (UIT-150 from Ushio, Inc.). In addition, the UV crosslinking operation was performed for 4 minutes while circulating water of 30° C. in the aluminum drum. Further, the outermost layer was heated for 30 minutes at 130° C. Thus, a crosslinked outermost layer having a thickness of about 4.0 μm was formed on the charge transport layer.

(Formation of Projected Portions)

The above-prepared outermost layer coating liquid was coated on the outermost layer using the spray gun. The coating conditions were as follows.

Pressure: 2 kgf/mm$^2$

Discharge rate of the coating liquid: 8 g/min

Revolution of rotated (photoreceptor) drum: 100 rpm

Oscillating speed: 5 mm/sec

The thus coated projected portions were also subjected to the UV crosslinking treatment and the heat treatment mentioned above. As a result, projected portions including a crosslinked resin and no filler were formed on the surface of the outermost layer.

Figure 13A:
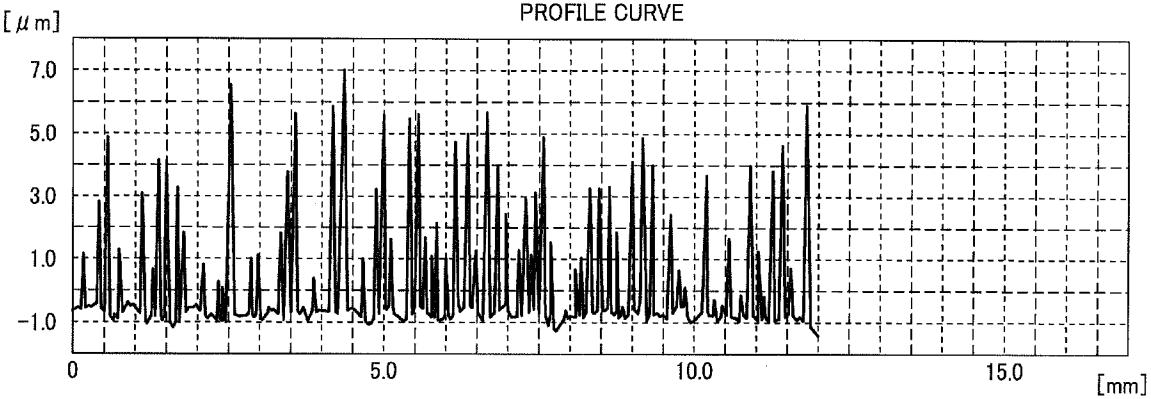
FIGS. 13A and 13B are the profile curve and roughness curve of the surface of a photoreceptor of Example 1, respectively.
Figure 13B:
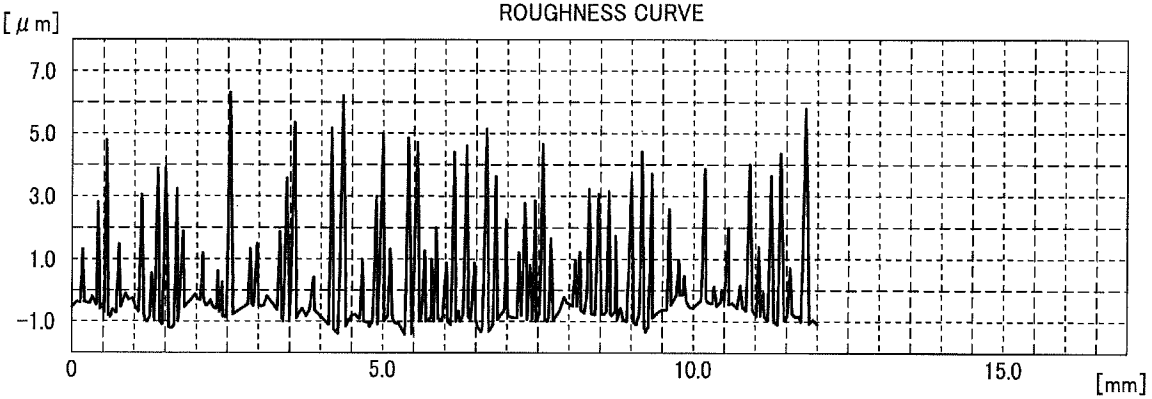

The profile of the surface of the thus prepared photoreceptor was obtained using a surface roughness tester (SURFCOM 1400D from Tokyo Seimitsu Co., Ltd.) with a measuring head DT43801. The profile curve and the roughness curve of the surface of the photoreceptor are shown in FIGS. 13A and 13B, respectively. In the figures, the vertical magnification and the horizontal magnification are 5,000 and 10, respectively, and the measuring length is 12 mm. The roughness curve illustrated in FIG. 13B is obtained by removing waviness components from the profile curve illustrated in FIG. 13A. The ten-point mean roughness Rz of the surface of the photoreceptor is 5.8 μm, which is determined by the method defined in JIS 30610 (2001).

The projected portions formed on the surface of the photoreceptor have a shape obtained by rotating a parabola on the axis thereof. The profile curve illustrated in FIG. 13A has a shape like a comb. Thus, it was found that plural independent projected portions extending in the vertical direction (i.e., Z-direction) are randomly present on the surface of the photoreceptor. Since the vertical magnification is different from the horizontal magnification in the profile curve illustrated in FIG. 13A, the projected portions seem to have a shape like a spike, but in reality the projected portions have a gentle slope. Namely, the projected portions have such a shape as illustrated in FIGS. 3 and 14.

Next, the number of the projected portions was counted by the method mentioned above. Specifically, at first the ground portion of the projected portions (i.e., the surface nearest to the surface of the outermost layer) was determined in the profile curve. Next, on the basis of the thus determined ground, the height of each of the peaks was determined, and the number of the peaks having a height of not less than Rz/2 (i.e., 2.9 μm) present in a measurement range of from 0 to 12 mm was counted. As a result, the number of the projected portions was 45. In this regard, shoulders and sub-peaks of main peaks were disregarded. The average height of the 45 projected portions was determined to be 4.95 μm. The measurement conditions were as follows.

Measurement method: JIS B0610 (2001)
Measurement length: 12 mm
Cut off wavelength: 0.8 mm
Measurement magnification: ×20K
Measurement speed: 0.06 mm/sec
Cut off: R2C (phase compensation)
Slope correction: The least squares method was used.

Figure 14:
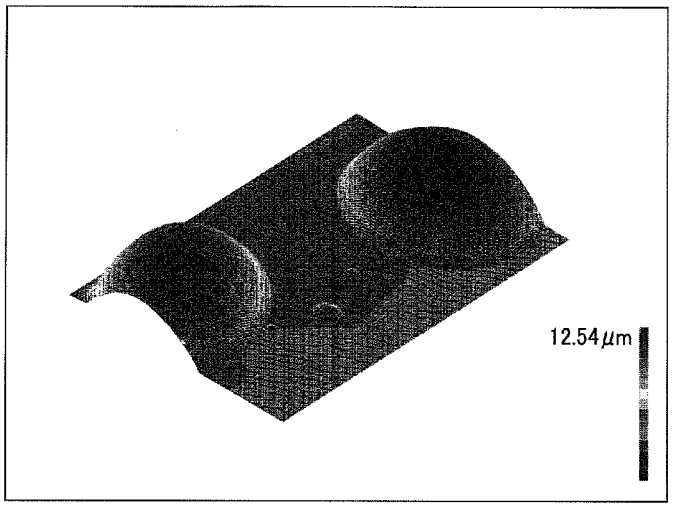
FIG. 14 is a three dimensional view of the surface of the photoreceptor of Example 1 obtained by a laser microscope.

The surface of the photoreceptor observed with a laser microscope (VK-8500 from Keyence Corporation) using an obj ective lens of 100 power magnification is illustrated in FIG. 14. In FIG. 14, the ratio of the vertical magnification to the horizontal magnification is 50/1. It is clear from FIG. 11 that plural independent projected portions having a smooth base are formed.

In this example, a polyurethane blade was used as the cleaning blade, and the blade was contacted with the photoreceptor at a linear pressure of 80 g/cm.

The details of the cleaning blade are as follows.
Hardness of the blade: 70° (rubber hardness)
Rebound resilience coefficient: 15% at 23° C.
300% modulus: 3720 N/cm$^2$
Tensile strength: 4970 N/cm$^2$
Tension set: 1.70%
Contact angle of blade against photoreceptor: 30°

Example 2

The procedure for preparation of the photoreceptor in Example 1 was repeated except that the spray coating conditions for forming the projected portions were changed as follows.

Pressure: 3 kgf/mm$^2$
Discharge rate of the coating liquid: 8 g/min
Revolution of rotated (photoreceptor) drum: 300 rpm
Oscillating speed: 10 mm/sec Thus, a photoreceptor of Example 2 was prepared. The linear pressure of the cleaning blade was the same as that in Example 1.

Example 3

The procedure for preparation of the photoreceptor in Example 1 was repeated except that the spray coating conditions for forming the projected portions were changed as follows.

Pressure: 2 kgf/mm$^2$
Discharge rate of the coating liquid: 4 g/min
Revolution of rotated (photoreceptor) drum: 200 rpm
Oscillating speed: 10 mm/sec Thus, a photoreceptor of Example 3 was prepared. The linear pressure of the cleaning blade was the same as that in Example 1.

Example 4

The procedure for preparation of the photoreceptor in Example 1 was repeated except that the spray coating conditions for forming the projected portions were changed as follows.

Pressure: 1 kgf/mm$^2$
Discharge rate of the coating liquid: 8 g/min
Revolution of rotated (photoreceptor) drum: 200 rpm
Oscillating speed: 15 mm/sec Thus, a photoreceptor of Example 4 was prepared. The linear pressure of the cleaning blade was the same as that in Example 1.

Example 5

The procedure for preparation of the photoreceptor in Example 1 was repeated except that the spray coating conditions for forming the projected portions were changed as follows.

Pressure: 2 kgf/mm$^2$
Discharge rate of the coating liquid: 12 g/min
Revolution of rotated (photoreceptor) drum: 300 rpm
Oscillating speed: 15 mm/sec Thus, a photoreceptor of Example 5 was prepared. The linear pressure of the cleaning blade was the same as that in Example 1.

Example 6

The procedure for preparation of the photoreceptor in Example 1 was repeated, and the linear pressure of the cleaning blade contacted with the photoreceptor was changed to 100 g/cm.

Example 7

The procedure for preparation of the photoreceptor in Example 2 was repeated, and the linear pressure of the cleaning blade contacted with the photoreceptor was changed to 100 g/cm.

Example 8

The procedure for preparation of the photoreceptor in Example 3 was repeated, and the linear pressure of the cleaning blade contacted with the photoreceptor was changed to 100 g/cm.

Example 9

The procedure for preparation of the photoreceptor in Example 4 was repeated, and the linear pressure of the cleaning blade contacted with the photoreceptor was changed to 100 g/cm.

Example 10

The procedure for preparation of the photoreceptor in Example 5 was repeated, and the linear pressure of the cleaning blade contacted with the photoreceptor was changed to 100 g/cm.

Example 11

The procedure for preparation of the photoreceptor in Example 1 was repeated, and the linear pressure of the cleaning blade contacted with the photoreceptor was changed to 120 g/cm.

Example 12

The procedure for preparation of the photoreceptor in Example 2 was repeated, and the linear pressure of the cleaning blade contacted with the photoreceptor was changed to 120 g/cm.

Example 13

The procedure for preparation of the photoreceptor in Example 3 was repeated, and the linear pressure of the cleaning blade contacted with the photoreceptor was changed to 120 g/cm.

Example 14

The procedure for preparation of the photoreceptor in Example 4 was repeated, and the linear pressure of the cleaning blade contacted with the photoreceptor was changed to 120 g/cm.

Example 15

The procedure for preparation of the photoreceptor in Example 5 was repeated, and the linear pressure of the cleaning blade contacted with the photoreceptor was changed to 120 g/cm.

Example 16

The procedure for preparation of the photoreceptor in Example 1 was repeated, and the linear pressure of the cleaning blade contacted with the photoreceptor was changed to 150 g/cm.

Example 17

The procedure for preparation of the photoreceptor in Example 2 was repeated, and the linear pressure of the cleaning blade contacted with the photoreceptor was changed to 150 g/cm.

Example 18

The procedure for preparation of the photoreceptor in Example 3 was repeated, and the linear pressure of the cleaning blade contacted with the photoreceptor was changed to 150 g/cm.

Example 19

The procedure for preparation of the photoreceptor in Example 4 was repeated, and the linear pressure of the cleaning blade contacted with the photoreceptor was changed to 150 g/cm.

Example 20

The procedure for preparation of the photoreceptor in Example 5 was repeated, and the linear pressure of the cleaning blade contacted with the photoreceptor was changed to 150 g/cm.

Comparative Example 1

The procedure for preparation of the photoreceptor in Example 5 was repeated except that the spray coating for forming the projected portions was not performed.

Figure 15:
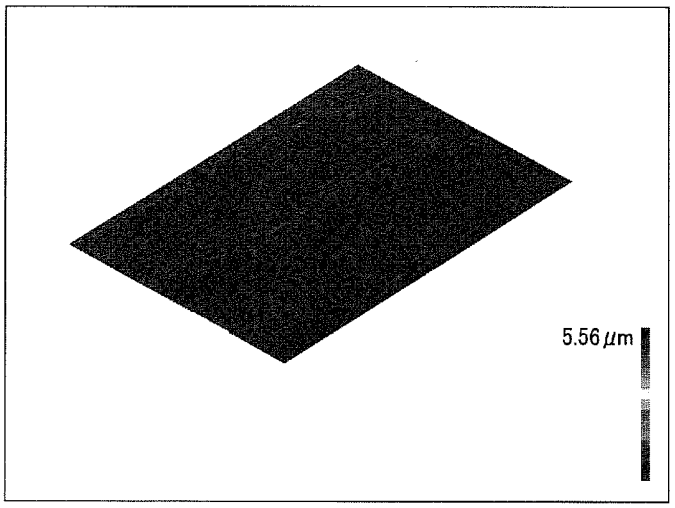
FIG. 15 is a three dimensional view of the surface of a photoreceptor of Comparative Example 1 obtained by a laser microscope.

The surface of the photoreceptor observed with the laser microscope is illustrated in FIG. 15. It is clear from FIG. 15 that the surface is flat and no projected portion is present.

In Comparative Example 1, the linear pressure of the cleaning blade is the same as that in Example 1.

Comparative Example 2

The photoreceptor of Comparative Example 1 was subjected to blast finishing using glass beads. Specifically, a mixture of glass beads and air was sprayed to collide against the surface of the photoreceptor, which was horizontally set while rotated, thereby roughening the surface of the photoreceptor. The blast finishing conditions were as follows.

Diameter of glass beads: 50 μm

Spraying pressure: 2.5 kgf/cm

Moving speed of spray gun: 460 mm/min

Figure 16A:
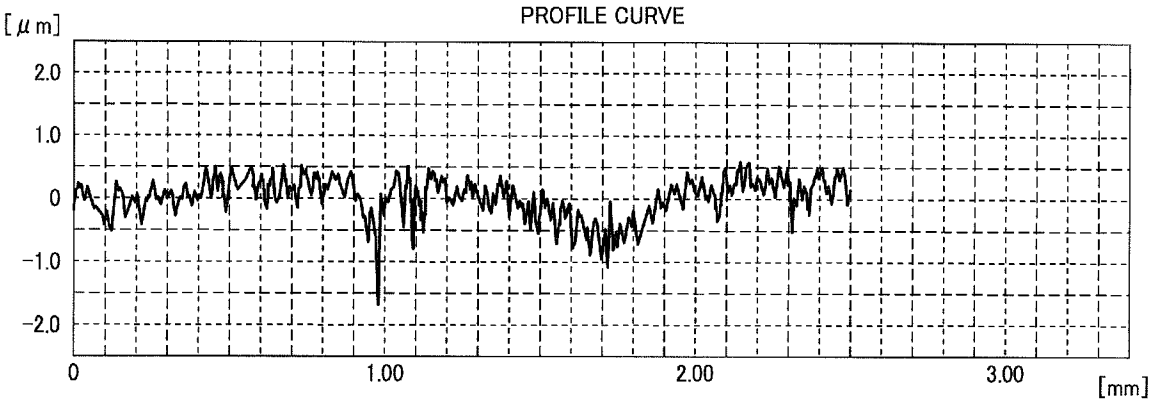
FIGS. 16A and 16B are the profile curve and roughness curve of the surface of a photoreceptor of Comparative Example 2, respectively.
Figure 16B:
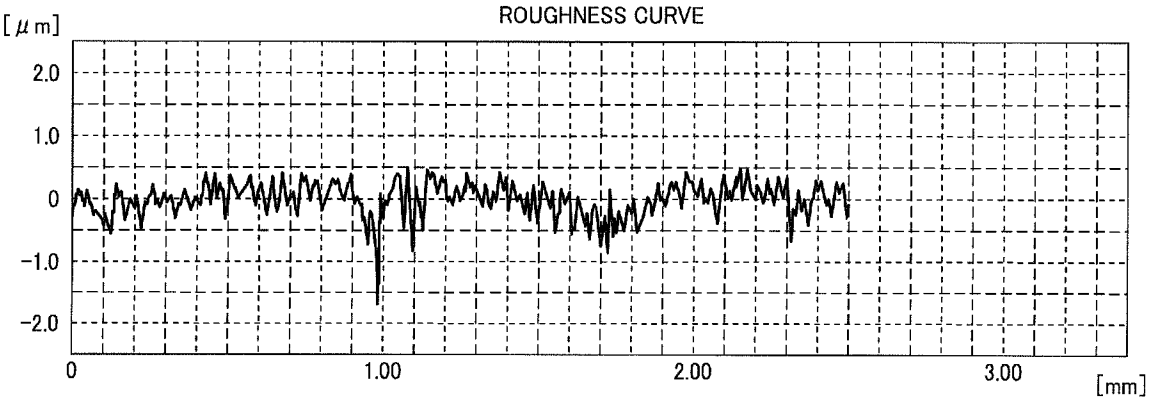

The profile curve and roughness curve of the photoreceptor are illustrated in FIGS. 16A and 16B, respectively. It is clear from FIGS. 16A and 16B that projections like teeth of a comb are not formed unlike the surface of the photoreceptor of Example 1. It was determined from the roughness curve that the ten-point mean roughness Rz is 1.479 μm. In addition, the surface has deep flaws and microscopic cracks (i.e., deep recessed portions), which are considered to be caused by collision of glass beads. In this case, the linear pressure of the cleaning blade contacted with the surface of the photoreceptor was 120 g/cm.

Comparative Example 3

The procedure for preparation of the photoreceptor in Example 3 was repeated, and the linear pressure of the cleaning blade was changed to 60 g/cm.

Comparative Example 4

The procedure for preparation of the photoreceptor in Example 3 was repeated, and the linear pressure of the cleaning blade was changed to 170 g/cm.

Comparative Example 5

The procedure for preparation of the photoreceptor in Example 1 was repeated except that the spray coating conditions for forming the projected portions were changed as follows.

Pressure: 1 kgf/mm$^2$

Discharge rate of the coating liquid: 4 g/min

Revolution of rotated (photoreceptor) drum: 300 rpm

Oscillating speed: 5 mm/sec

Thus, a photoreceptor of Comparative Example 5 was prepared. The linear pressure of the cleaning blade was the same as that in Example 1.

Comparative Example 6

The procedure for preparation of the photoreceptor in Example 1 was repeated except that the spray coating conditions for forming the projected portions were changed as follows.

Pressure: 3 kgf/mm$^2$

Discharge rate of the coating liquid: 4 g/min

Revolution of rotated (photoreceptor) drum: 100 rpm

Oscillating speed: 15 mm/sec

Thus, a photoreceptor of Comparative Example 5 was prepared. The linear pressure of the cleaning blade was the same as that in Example 1.

Comparative Example 7

A photoreceptor having well-form projections and recesses was prepared by the method described in the above-mentioned background art JP-A 2001-66814. Specifically, an aluminum cylinder was subjected to horning so as to have a rough surface having a roughness Ra (i.e., Arithmetical Mean Deviation of the Profile) of 0.18 μm.

(Formation of Undercoat Layer)

The following undercoat layer coating liquid was prepared and applied on the rough surface of the aluminum cylinder by a dip coating method, followed by drying to form an undercoat layer with a thickness of 1.2 μm.

| | |
|---|---|
| Polyvinyl butyral (S-LEC BM-S from Sekisui Chemical Co., Ltd.) | 4 parts |
| Acetylacetone zirconium butyrate | 30 parts |
| γ -aminopropyltrimethoxy silane | 3 parts |

(Formation of Charge Generation Layer)

The following components were mixed and the mixture was subjected to a dispersing treatment for 4 hours using a sand mill to prepare a charge generation layer coating liquid.

| | |
|---|---|
| Chloro gallium phthalocyanine (serving as a charge generation material and having an X-ray diffraction spectrum such that peaks are observed at Bragg 2θ angles of 7.4°, 16.6°, 25.5° and 28.3° when CuKα is used) | 3 parts |
| Vinyl chloride - vinyl acetate copolymer (VMCH from Nippon Unicar Company Limited) | 2 parts |
| Butyl acetate | 180 parts |

The thus prepared charge generation layer coating liquid was applied on the undercoat layer by a dip coating method, followed by drying to form a charge generation layer with a thickness of 0.2 μm.

(Formation of Charge Transport Layer)

The following components were mixed to prepare a solution.

| | |
|---|---|
| N,N'-diphenyl-N,N-bis(3-methylphenyl)-[1,1'-bisphenyl]-4,4'-diamine | 4 parts |
| Polycarbonate resin (IUPILON Z400 from Mitsubishi Chemical Corporation) | 6 parts |
| Tetrahydrofuran | 60 parts |
| 2,6-di-t-butyl-4-methylphenol | 0.2 parts |

Further, 3 parts of a particulate silica (TOSPEARL 102 from Toshiba Silicone Co., Ltd. having a volume average particle diameter of 500 nm) was added to the solution, and then the mixture was subjected to a dispersing treatment to prepare a charge transport layer coating liquid.

The thus prepared charge transport layer coating liquid was applied on the charge generation layer by a dip coating method, followed by drying to form a charge transport layer with a thickness of 25 μm.

(Formation of Projected Portions)

According to the method described in the background art JP-A 2001-66814, a die equipped with a stamper having plural projected portions was pressed to the surface of the charge transport layer to form (transfer) projected portions on the surface of the charge transport layer.

As a result, well-form recessed portions, each of which has a diameter of 0.7 μm and an average depth of 0.5 μm and which are arranged at a pitch of 1.1 μm, were formed on the surface of the charge transport layer.

In Comparative Example 7, the linear pressure of the cleaning blade was 120 g/cm.

The roughness curves of these photoreceptors of Examples 2-20, and Comparative Examples 1-7 were obtained by the method mentioned above in Example 1.

The results are shown in Tables 3-5 below.

The photoreceptors of Examples 1-20, and Comparative Examples 1-7 were evaluated as follows.

1. Image qualities

Each photoreceptor was set in a process cartridge, and the cartridge was set in a modified digital copier C455 from Ricoh Co., Ltd., which uses a laser diode emitting a laser beam having a wavelength of 655 nm as the light source of the light irradiating device, a charging roller, and a cleaning blade, and a running test in which 50,000 copies of an original image are continuously produced was performed. The image forming conditions were as follows.

Toner used: polymerization toner having a volume average particle diameter of 6 μm Environmental conditions: 25° C. 65% RH Potential (Vd) of dark portion of photoreceptor: −800V Potential (Vl) of irradiated portion of photoreceptor: −200V Receiving material: TYPE 6200 paper from Ricoh Co., Ltd. (A4 size)

Original image: Test chart having photographic images and character images (for use in evaluating black solid image, half tone image and background)

The evaluation of the photoreceptor was performed as follows.

(1) Durability of Photoreceptor

The image qualities of the tenth to twentieth copies at the beginning of the running test, and first to tenth images produced after the running test were compared to determine whether the image qualities deteriorate.

In addition, the tip of the cleaning blade was observed with a microscope after the running test. The evaluation items are as follows.

(A) Passing of Toner Through Gap Between Blade and Photoreceptor (I.e., Toner Blocking Property)

The images produced after the running test were observed to determine whether a streak image caused by passing of the toner through the gap between the blade and the photoreceptor is present in the images. The images were graded as follows.

Grade A: The images have no streak image. (Excellent)

Grade B: The images have a slight streak image.

Grade C: The images have a clear streak image.

Grade D: The images have two or more clear streak images. (Bad)

(B) Fixation of Toner on Photoreceptor (I.e., Toner Fixation Resistance)

The surface of the photoreceptor was observed to determine whether the toner is fixed on the photoreceptor. In addition, the images produced after the running test were observed to determine whether abnormal images caused by a fixed toner are produced. The images were graded as follows.

Grade A: The toner is not fixed on the surface of the photoreceptor, and no abnormal image is produced. (Excellent)

Grade B: The toner is slightly fixed on a small portion of the surface of the photoreceptor, and a minor abnormal image is produced in a small portion of the image.

Grade C: The toner is fixed on a portion of the surface of the photoreceptor, and an abnormal image is produced in a portion of the image.

Grade D: The toner is fixed on the entire portion of the surface of the photoreceptor, and an abnormal image is produced in the entire portion of the image. (Bad)

(C) Overall Evaluation

Overall evaluation of the photoreceptor was performed as follows.

Grade (A): At the beginning of the running test, the photoreceptor is graded A in each of the toner passing property and toner fixation property. In addition, after the running test, the photoreceptor is graded B in each of the toner passing property and toner fixation property, and the cleaning blade has no problem. (Good)

Grade (B): At the beginning of the running test, the photoreceptor is graded B in the toner passing property. In addition, after the running test, the photoreceptor is graded B in each of the toner passing property and toner fixation property, and the cleaning blade has no problem.

Grade (C): The photoreceptor is graded C at least one of the toner passing property and toner fixation property before or after the running test.

The evaluation results are shown in Tables 3-5.

TABLE 3

| | Rz/2 (μm) | Number of projected portions (pieces/12 mm) | Height of projected portions (μm) | Linear pressure of blade (g/cm) |
|---|---|---|---|---|
| Example 1 | 2.9 | 45 | 5.0 | 80 |
| Example 2 | 2.3 | 86 | 3.7 | 80 |
| Example 3 | 1.6 | 79 | 2.5 | 80 |
| Example 4 | 2.0 | 62 | 3.3 | 80 |
| Example 5 | 3.2 | 55 | 5.2 | 80 |
| Example 6 | 2.9 | 45 | 5.0 | 100 |
| Example 7 | 2.3 | 86 | 3.7 | 100 |
| Example 8 | 1.6 | 79 | 2.5 | 100 |
| Example 9 | 2.0 | 62 | 3.3 | 100 |
| Example 10 | 3.2 | 55 | 5.2 | 100 |
| Example 11 | 2.9 | 45 | 5.0 | 120 |
| Example 12 | 2.3 | 86 | 3.7 | 120 |
| Example 13 | 1.6 | 79 | 2.5 | 120 |
| Example 14 | 2.0 | 62 | 3.3 | 120 |
| Example 15 | 3.2 | 55 | 5.2 | 120 |
| Example 16 | 2.9 | 45 | 5.0 | 150 |
| Example 17 | 2.3 | 86 | 3.7 | 150 |
| Example 18 | 1.6 | 79 | 2.5 | 150 |
| Example 19 | 2.0 | 62 | 3.3 | 150 |
| Example 20 | 3.2 | 55 | 5.2 | 150 |
| Comparative Example 1 | — | — | — | 120 |

TABLE 3-continued

| | Rz/2 (μm) | Number of projected portions (pieces/12 mm) | Height of projected portions (μm) | Linear pressure of blade (g/cm) |
|---|---|---|---|---|
| Comparative Example 2 | — | — | — | 120 |
| Comparative Example 3 | 1.6 | 79 | 2.5 | 60 |
| Comparative Example 4 | 1.6 | 79 | 2.5 | 170 |
| Comparative Example 5 | 1.3 | 35 | 2.0 | 120 |
| Comparative Example 6 | 0.8 | 273 | 1.0 | 120 |
| Comparative Example 7 | — | — | — | 120 |

TABLE 4

| | At beginning of running test | | After running test | |
|---|---|---|---|---|
| | Toner blocking property | Toner fixation resistance | Toner blocking property | Toner fixation resistance |
| Example 1 | A | A | B | B |
| Example 2 | A | A | B | B |
| Example 3 | A | A | B | B |
| Example 4 | A | A | B | B |
| Example 5 | B | A | B | B |
| Example 6 | A | A | B | B |
| Example 7 | A | A | B | B |
| Example 8 | A | A | B | B |
| Example 9 | A | A | B | B |
| Example 10 | B | A | B | B |
| Example 11 | A | A | B | B |
| Example 12 | A | A | B | B |
| Example 13 | A | A | B | B |
| Example 14 | A | A | B | B |
| Example 15 | B | A | B | B |
| Example 16 | A | A | B | B |
| Example 17 | A | A | B | B |
| Example 18 | A | A | B | B |
| Example 19 | A | A | B | B |
| Example 20 | B | A | B | B |
| Comparative Example 1 | B | B | D | C |
| Comparative Example 2 | B | B | D | D |
| Comparative Example 3 | C | B | D | C |
| Comparative Example 4 | D | B | D | C |
| Comparative Example 5 | B | B | D | C |
| Comparative Example 6 | B | B | C | D |
| Comparative Example 7 | B | C | C | D |

TABLE 5

| | Problems occurring in running test | Overall evaluation |
|---|---|---|
| Example 1 | No problem | A |
| Example 2 | No problem | A |
| Example 3 | No problem | A |
| Example 4 | No problem | A |
| Example 5 | No problem | B |
| Example 6 | No problem | A |
| Example 7 | No problem | A |
| Example 8 | No problem | A |
| Example 9 | No problem | A |
| Example 10 | No problem | B |

TABLE 5-continued

| | Problems occurring in running test | Overall evaluation |
|---|---|---|
| Example 11 | No problem | A |
| Example 12 | No problem | A |
| Example 13 | No problem | A |
| Example 14 | No problem | A |
| Example 15 | No problem | B |
| Example 16 | No problem | A |
| Example 17 | No problem | A |
| Example 18 | No problem | A |
| Example 19 | No problem | A |
| Example 20 | No problem | B |
| Comparative Example 1 | Vibration and reversing of the blade were caused. | C |
| Comparative Example 2 | Black streak images caused by scratches of the surface of the photoreceptor were formed. | C |
| Comparative Example 3 | No problem | C |
| Comparative Example 4 | The blade was seriously abraded. | C |
| Comparative Example 5 | Vibration and reversing of the blade were caused. | C |
| Comparative Example 6 | Vibration and reversing of the blade were caused. | C |
| Comparative Example 7 | The blade was seriously abraded. | C |

The following is clearly understood from Tables 3-5.

(1) By forming specific projected portions on the surface of a photoreceptor, vibration, reversing and twisting of a cleaning blade can be avoided.

(2) When the projected portions have a height of greater than 5 μm, there is a case where the photoreceptor produces images having a minor defect (such as streak images caused by toner passing). However, after repeating image formation, the defect disappeared.

(3) When the number of the projected portions is less than 40 or greater than 90 in the range of 12 mm, abnormal images are formed.

(4) The linear pressure of the cleaning blade is preferably from 80 to 150 g/cm.

(5) When the height of the projected portions is not greater than 5.0 μm, the photoreceptor has good toner blocking property at the beginning of the running test and after the running test.

(6) In the case of the photoreceptor of Comparative Example 1, which has no specific projected portions thereon, vibration and reversing of the cleaning blade occur, resulting in occurrence of the toner passing problem. This is because the friction between the blade and the photoreceptor is relatively high.

(7) In the case of the photoreceptor of Comparative Example 2, whose surface is subjected to blast finishing using glass beads, black streak images are formed due to scratches formed on the surface of the photoreceptor caused by the blast finishing. In addition, since the contact area of the blade with the surface of the photoreceptor is large, vibration, twisting and reversing of the cleaning blade occur, resulting in occurrence of the toner passing problem.

(8) In the case of the photoreceptor of Comparative Example 3, the toner passing problem is caused even at the beginning of the running test because the linear pressure of the cleaning blade is too low.

(9) In the case of the photoreceptor of Comparative Example 4, vibration, twisting and reversing of the cleaning blade occurs, resulting in occurrence of the toner passing problem. This is because the linear pressure of the cleaning blade is too high.

(10) In the case of the photoreceptor of Comparative Example 5, the effects of the present invention cannot be produced because the number of the projected portions is too small.

(11) In the case of the photoreceptor of Comparative Example 6, the tip of the cleaning blade is chipped, resulting in occurrence of the toner passing problem. This is because the number of the projected portions is too large.

(12) In the case of the photoreceptor of Comparative Example 7, some projected portions on the surface of the photoreceptor are destroyed, resulting in formation of a large projected portion in which the destroyed projected portions are connected. Due to the large projected portion, the toner fixation problem and the toner passing problem are caused. In addition, the tip of the cleaning blade is chipped by the large projected portion.

As mentioned above, high quality images can be produced over a long period of time by an image forming apparatus including a photoreceptor which has an electroconductive substrate, a photosensitive layer and an outermost layer having projected portions thereon, wherein the outermost layer and the projected portions include the same crosslinked charge transport material, and wherein the outermost layer has a surface roughness property such that the number of projected portions having a height greater than Rz/2 (Rz: ten-point mean roughness) is from 40 to 90 per a scanning length of 12 mm when the surface roughness is measured by a method defined in JIS B0601 (2001), and a cleaning blade for cleaning the surface of the photoreceptor, wherein the linear pressure of the tip edge line of the blade against the photoreceptor is 80 g/cm to 150 g/cm.

Additional modifications and variations of the present invention are possible in light of the above teachings. It is therefore to be understood that within the scope of the appended claims the invention may be practiced other than as specifically described herein.

This document claims priority and contains subject matter related to Japanese Patent Application No. 2008-291650, filed on Nov. 14, 2008, the entire contents of which are herein incorporated by reference.

What is claimed is:

1. An image forming apparatus comprising:

at least one photoreceptor configured to bear an electrostatic latent image thereon, wherein the photoreceptor includes an electroconductive substrate, a photosensitive layer located overlying the substrate, and an outermost layer having projected portions thereon, wherein the outermost layer and the projected portions include a same crosslinked charge transport material, and wherein the outermost layer has a surface roughness property such that a number of projected portions having a height greater than Rz/2 is from 40 to 90 in a measurement length of 12 mm, wherein Rz represents ten-point mean roughness of a surface of the outermost layer;

a developing device configured to develop the electrostatic image with a developer including a toner to form a toner image on a surface of the photoreceptor;

a transferring device configured to transfer the toner image onto a receiving material; and a cleaning device having a cleaning blade configured to clean the surface of the photoreceptor after the toner image is transferred, wherein a tip edge line of the cleaning blade is contacted with the surface of the photoreceptor at a linear pressure of from 80 g/cm to 150 g/cm, wherein the projected portions form peaks and valleys on the surface of the outermost layer, and the ten-point mean roughness Rz is a difference between (a) a mean value of altitude of from the highest peak to the fifth highest peak in a profile of the surface and (b) a mean value of altitude of from the deepest valley to the fifth deepest valley in the profile of the surface.

2. The image forming apparatus according to claim 1, wherein the projected portions have an average height of not greater than 5 μm in the scanning length of 12 mm.

3. The image forming apparatus according to claim 1, wherein the crosslinked charge transport material included in the outermost layer and the projected portions has a unit obtained from a triarylamine compound.

4. The image forming apparatus according to claim 3, wherein the triarylamine compound has the following formula (1):

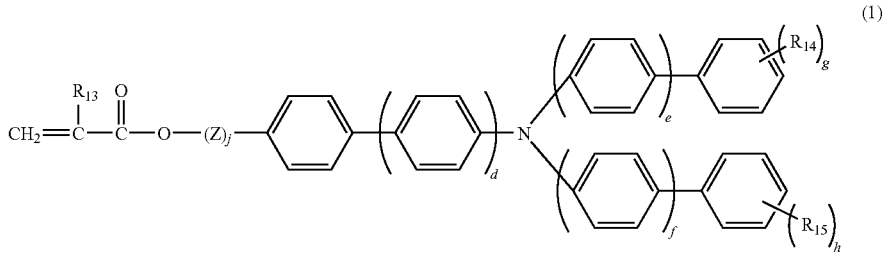

(1)

wherein each of d, e and f is 0 or 1; each of g and h is 0 or an integer of from 1 to 3; $R_{13}$ represents a hydrogen atom or a Methyl group; each of $R_{14}$ and $R_{15}$ represents an alkyl group having from 1 to 6 carbon atoms, wherein when g is 2 or 3, the groups $R_{14}$ may be the same as or different from each other, and when h is 2 or 3, the groups $R_{15}$ may be the same as or different from each other; Z represents a methylene group, an ethylene group or one of the following groups:

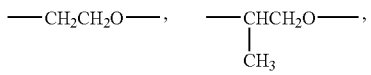

-continued

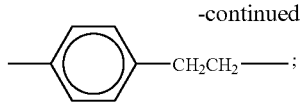

and j is 0 or 1.

5. The image forming apparatus according to claim 1, wherein projected portions are formed by a spray coating method.

6. The image forming apparatus according to claim 1, wherein the toner is a toner prepared by a polymerization method.

7. The image forming apparatus according to claim 1, including plural photoreceptors, wherein the developing device includes plural tandem developing units configured to form different color toner images on the respective photoreceptors.

* * * * *